US005904425A

United States Patent [19]

May

[11] Patent Number: 5,904,425

[45] **Date of Patent: *May 18, 1999**

[54] CLOSURE ARRANGEMENT HAVING A PEELABLE SEAL

[75] Inventor: Timothy J. May, Greenville, Wis.

[73] Assignee: Reynolds Consumer Products, Inc., Appleton, Wis.

[ * ] Notice: This patent is subject to a terminal disclaimer.

[21] Appl. No.: 08/951,482

[22] Filed: Oct. 16, 1997

Related U.S. Application Data

[60] Division of application No. 08/712,916, Sep. 12, 1996, Pat. No. 5,725,312, which is a continuation-in-part of application No. 08/603,145, Feb. 20, 1996, Pat. No. 5,647,671, which is a continuation-in-part of application No. 08/499,621, Jul. 7, 1995, abandoned, which is a division of application No. 08/225,864, Apr. 11, 1994, Pat. No. 5,470,156.

[51] Int. Cl.[6] ..... B65D 33/16

[52] U.S. Cl. ..... 383/203; 383/61; 383/63; 383/207; 383/210; 493/214

[58] Field of Search ..... 383/61, 63, 64, 383/65, 203, 204, 207, 208, 210, 211; 493/214

[56] References Cited

U.S. PATENT DOCUMENTS

| | | | |
|---|---|---|---|
| 3,198,228 | 8/1965 | Naito | 383/63 |
| 3,256,981 | 6/1966 | Kurtz | 206/56 |
| 3,368,740 | 2/1968 | Rohde | 229/66 |
| 3,535,409 | 10/1970 | Rohde | 264/95 |
| 3,625,270 | 12/1971 | Skendzic | 150/3 |
| 3,655,503 | 4/1972 | Stanley et al. | 161/165 |
| 3,711,011 | 1/1973 | Kugler | 229/7 R |
| 3,827,625 | 8/1974 | Miller | 229/62 |
| 4,097,236 | 6/1978 | Daly et al. | 23/230 L |
| 4,279,677 | 7/1981 | Takahashi | 156/160 |
| 4,295,919 | 10/1981 | Sutrina et al. | 156/498 |
| 4,355,494 | 10/1982 | Tilman | 493/214 |
| 4,522,305 | 6/1985 | Jacobsson | 206/632 |
| 4,576,285 | 3/1986 | Goglio | 206/632 |
| 4,589,145 | 5/1986 | Van Erden et al. | 383/5 |
| 4,630,311 | 12/1986 | Bentson | 383/37 |
| 4,638,913 | 1/1987 | Howe, Jr. | 206/632 |
| 4,663,915 | 5/1987 | Van Erden et al. | 53/450 |
| 4,834,552 | 5/1989 | Makowka | 383/5 |
| 4,846,585 | 7/1989 | Boeckmann et al. | 383/63 |
| 4,855,168 | 8/1989 | Imaizumi | 428/35.2 |
| 4,875,587 | 10/1989 | Lulham et al. | 206/484 |
| 4,889,731 | 12/1989 | Williams, Jr. | 426/106 |
| 4,923,309 | 5/1990 | VanErden | 383/61 |
| 4,925,316 | 5/1990 | Van Erden et al. | 383/61 |
| 4,925,318 | 5/1990 | Sorensen | 383/63 |
| 4,944,409 | 7/1990 | Busche et al. | 206/632 |
| 4,966,470 | 10/1990 | Thompson et al. | 383/61 |

(List continued on next page.)

*Primary Examiner*—Stephen P. Garbe
*Attorney, Agent, or Firm*—Alan M. Biddison

[57] ABSTRACT

A closure arrangement for a polymeric bag has a pair of opposing films joined at a fold line and perforated along the fold line. The arrangement includes a base strip, a pair of heat-resistant strips, and a peelable strip composed of peelable material. The base strip has opposing inner and outer surfaces, and the outer surface of the base strip is securably arranged with respect to one of the pair of opposing films of the polymeric bag. The pair of heat-resistant strips are securably arranged to the inner surface of the base strip, and are spaced from each other so as to form a gap therebetween. The peelable strip includes a first portion having opposing first and second surfaces and a stem portion extending perpendicular to the first surface of the top portion. The stem portion extends into the gap between the pair of heat-resistant strips and is arranged with respect to the inner surface of the base strip. Various other closure arrangements are also disclosed.

4 Claims, 9 Drawing Sheets

U.S. PATENT DOCUMENTS

| | | | |
|---|---|---|---|
| 4,969,967 | 11/1990 | Sorensen et al. | 156/66 |
| 5,017,021 | 5/1991 | Simonsen et al. | 383/63 |
| 5,022,530 | 6/1991 | Zieke | 383/61 |
| 5,033,868 | 7/1991 | Peppiatt | 383/29 |
| 5,063,069 | 11/1991 | Van Erden et al. | 426/122 |
| 5,064,664 | 11/1991 | Hustad | 426/87 |
| 5,077,001 | 12/1991 | Makowka | 383/5 |
| 5,082,702 | 1/1992 | Alband | 428/36.92 |
| 5,103,979 | 4/1992 | Hustad | 206/459 |
| 5,104,704 | 4/1992 | Labes et al. | 428/35.7 |
| 5,121,997 | 6/1992 | La Pierre et al. | 383/203 |
| 5,215,380 | 6/1993 | Custer et al. | 383/61 |
| 5,224,779 | 7/1993 | Thompson et al. | 383/5 |
| 5,238,306 | 8/1993 | Heintz et al. | 383/61 |
| 5,330,269 | 7/1994 | Kamada et al. | 383/210 |
| 5,456,928 | 10/1995 | Hustad et al. | 383/63 |
| 5,486,051 | 1/1996 | May | 383/200 |
| 5,489,252 | 2/1996 | May | 383/210 |
| 5,492,411 | 2/1996 | May | 383/6 |
| 5,509,735 | 4/1996 | May | 383/210 |
| 5,513,915 | 5/1996 | May | 383/210 |
| 5,647,671 | 7/1997 | May | 383/210 |

CLOSURE ARRANGEMENT HAVING A PEELABLE SEAL

CROSS-REFERENCE TO RELATED APPLICATIONS

This is a divisional of U.S. application Ser. No. 08/712,916, filed Sep. 12, 1996, now U.S. Pat. No. 5,725,312; which is a continuation-in-part of U.S. application Ser. No. 08/603,145 filed Feb. 20, 1996, now U.S. Pat. No. 5,647,671, which is a continuation-in-part of U.S. application Ser. No. 08/499,621 filed Jul. 7, 1995 (now abandoned); which is a division of U.S. application Ser. No. 08/225,864 filed Apr. 11, 1994, now U.S. Pat. No. 5,470,156, which are all incorporated by reference.

FIELD OF THE INVENTION

The present invention generally relates to closure arrangements for polymeric (plastic) bags and, more particularly, relates to a closure arrangement having a peelable seal or breakaway seal.

DESCRIPTION OF THE RELATED ART

In many consumer packaging applications, it is important to prevent air or water or the like from passing out of or into a package containing certain products. This is particularly true with respect to meat packages, cheese packages, and the like, for which the contained product must be kept in a constant environment to prevent spoilage. In order to preserve the product contained within such a package, the periphery of the package must be hermetically sealed. Hermetic seals can be provided by both permanent seals and temporary seals known as peelable seals. Peelable seals are capable of providing a hermetic seal and, at the same time, providing a consumer with access to the contents of a package. A consumer breaks a peelable seal of a package by first grabbing onto opposing film faces to which peelable seal materials are adhered and then pulling the film faces apart. To provide a peelable seal on a package with a reclosable zipper, the package typically uses permanent seals at its side edges and bottom edge and a peelable seal above or below the reclosable zipper at the mouth end of the package. In addition, the peelable seal may be arranged on either the flange/base portions of the zipper or on the packaging film adjacent to the flange portions.

Typically one sealing station is used to seal all the edges of a package and, at the same time, make a peelable seal from a strip of peelable materials. The sealing station has a set of seal bars, protruding from a sealing head, which press the package edges and the peelable strip against a resilient backing such as rubber to form both the permanent edge seals and the peelable seal. The strength of the seals is determined by the temperature, pressure, and dwell time of the seal bars.

The above process is slightly modified when a reclosable zipper is inserted at the mouth end of the package between the top and bottom films of the package, and a peelable seal is to be located above or below the zipper. In that situation, the package typically reaches the sealing station with the zipper adhered to only the bottom film. The sealing station has a seal bar for (1) adhering the top film to a flange portion of the zipper and (2) creating the peelable seal.

There are a couple of typical approaches for forming peelable seals on reclosable packages having a top and bottom film. One typical approach adheres a multilayered film to each of the opposing inner surfaces of the packaging film (or zipper flange portions) along the length of the mouth end of the package. This results in a first multilayered film on the inner surface of the top film and a second multilayered film on the inner surface of the bottom film. A peelable seal is formed by heat sealing the first and second multilayered films to one another. When a consumer breaks the peelable seal, one or more layers of the second multilayered film will disengage from the other layers of the second multilayered film and remain adhered to the first multilayered film. As a result, the first multilayered film will include at least one additional layer when the peelable seal is broken. The above layer disengagement upon breaking the peelable seal is accomplished by using film layers composed of different polymeric materials and by exploiting the varying bond strengths between the layers.

Another typical approach adheres a layer of film to each of the opposing inner surfaces of the packaging film (or zipper flange portions) and introduces contaminants to one or both of the film layers. When the peelable seal is formed by heat sealing the layers to one another, the bond between them is weak due to the surface contamination. Breaking the peelable seal detaches the layers from one another.

In a third approach for forming a peelable seal, the material of one of the two layers being heat sealed is selected to have a tear strength which is less than that of the heat seal formed between the two layers and the other layer is selected to have a tear strength which exceeds that of the heat seal. When the layers are pulled apart, the layer formed of the weaker material breaks internally. In this case, a portion of the weaker layer is torn away from itself and remains attached to the other layer. This form of a peelable seal is often referred to as a breakaway seal.

The foregoing approaches for forming peelable seals suffer from several drawbacks. One drawback is that the peelable seals are highly susceptible to small variations which might occur during manufacture, i.e., the peelable seals have low manufacturing tolerances. For example, slight variations in the temperature, pressure, or dwell time of the seal bar forming the peelable seal might create a peelable seal which is either too weak or too strong. An excessively weak peelable seal might not provide a hermetic seal, while an excessively strong peelable seal might be difficult for a consumer to break. Thus, the low manufacturing tolerances of the peelable seals leads to unpredictability and nonuniformity in the bond strength provided by the peelable seals.

Since the peelable seals are highly susceptible to small manufacturing variations, a related drawback of the foregoing approaches for forming peelable seals is that the peelable seals do not consistently break in the same manner from bag to bag. For instance, breaking a peelable seal on one bag might detach only one layer of the multilayered film, while breaking a peelable seal on another bag might detach more than one layer of the multilayered film.

Bags which include peelable or breakaway seals sometimes include a fold of film at a mouth portion of the bag. In order to access the interior of the bag, the fold of film must be severed or cut. At times, this may be inconvenient if a scissors or other cutting device is not easily accessible.

Consequently, a need exists for a closure arrangement for a polymeric bag which overcomes the aforementioned shortcomings associated with existing peelable seals.

SUMMARY OF THE INVENTION

Accordingly, the present invention provides a closure arrangement for a polymeric bag having a peelable seal which provides a hermetic seal and, at the same time, can be quickly and easily broken.

The present invention further provides a closure arrangement having a peelable seal which is relatively. insusceptible to small manufacturing variations.

The present invention further provides a closure arrangement having a peelable seal which is consistent in strength from one bag to the next and which breaks consistently from one bag to the next.

In one particular embodiment, a bag comprises first and second opposing films joined at a fold line and being perforated along the fold line, a first base strip, a pair of heat-resistant strips attached to the inner surface of the first base strip and being spaced from each other so as to form a gap therebetween, and a peelable strip. The peelable strip includes a first portion having opposing first and second surfaces and a stem portion extending substantially normal to the first surface of the top portion. The stem portion extends into the gap between the pair of heat-resistant strips and is arranged with respect to the inner surface of the base strip.

In another implementation, a bag comprises first and second opposing films joined at a fold line and being perforated along the fold line. The first and second base strips each have an inner and outer surface, and the inner surfaces of the first and second base strips form a plane opposing each other. The outer surfaces of the first and second base strips are arranged with respect to the respective first and second films. First and second opposing peelable bands are securably arranged with respect to the respective inner surface of the first and second base strips. The first and second peelable bands are constructed and arranged to form a peelable seal therebetween. A first heat-resistant strip including a projection is securably arranged with respect to the inner surface of the first base strip. A second heat-resistant strip is securably arranged with respect to the inner surface of the second base strip and includes a notch sized to receive the projection.

In another implementation, a bag comprises first and second opposing films having inner and outer surfaces and joined at a fold line and being perforated along the fold line. First and second opposing base strips each have an inner and outer surface, the outer surfaces of the first and second base strips are securably arranged with respect to the inner surfaces of the respective first and second films. A peelable strip has a pair of opposing surfaces, one of the surfaces is securably arranged with respect to the inner surface of the first base strip and the other of the surfaces is detachably arranged with respect to the inner surface of the second film to form a peelable seal. A pair of interlocking closure profiles are secured to the respective inner surfaces of the first and second base strips so that the bag is reclosable.

In another implementation, a bag comprises first and second opposing films joined at a fold line and being perforated along the fold line. First and second opposing base strips each have an inner and outer surface, the outer surfaces of the first and second base strips are held to the respective first and second films. At least two sealant ribs are securably arranged with respect to the inner surface of the first base strip. A peelable strip has a pair of opposing surfaces, one of the opposing surfaces is securably arranged with respect to the inner surface of the second base strip and the other of the opposing surfaces is securably arranged with respect to the sealant ribs to form one-time peelable seals.

In another implementation, a bag comprises first and second opposing films joined at a fold line and being perforated along the fold line. First and second opposing base strips each have an inner and outer surface, the outer surfaces of the first and second base strips are securably arranged with respect to the respective first and second films. A pair of sealant bands are securably arranged with respect to the inner surface of the first base strip. A pair of peelable bands have a pair of opposing surfaces, one of the opposing surfaces is securably arranged with respect to the inner surface of the second base strip, and the other of the opposing surfaces is securably arranged with respect to the sealant bands to form one-time peelable seals.

In another implementation, a bag comprises first and second opposing films joined at a fold line.. and being perforated along the fold line. A base strip has an inner and outer surface, the outer surface of the base strip is securably arranged with respect to the first film. A breakaway strip has inner and outer surfaces and is substantially co-planar with the base strip and is adjacent to the base strip such that the breakaway strip is detachably arranged with respect to the first base strip to form a breakaway seal. The inner surface of the breakaway strip is securably arranged with respect to the second film. First and second heat-resistant strips are included, where the first is securably arranged with respect to the inner surface of the base strip, and the second is securably arranged with respect to the outer surface of the breakaway strip.

In another implementation, a bag comprises first and second opposing films joined at a fold line and being perforated along the fold line. A first base strip has an inner and outer surface, the outer surface of the first base strip is securably arranged with respect to the first film. A breakaway member has a first leg having opposing inner and outer surfaces and opposing first and second sides extending between the inner and outer surfaces, where one of the first and second sides of the first leg is detachably arranged with respect to the first base strip to form a breakaway seal, and the inner surface of the first leg is securably arranged with respect to the second film.

In another implementation, a bag comprises a first panel having inner and outer surfaces, a second panel having inner and outer surfaces and forming a plane generally parallel to and opposing the first panel. The first and second panels are joined at a fold line and are perforated along the fold line. A first peelable strip of a first color is securably arranged with respect to the inner surface of the first panel. A second peelable strip of a second color is securably arranged with respect to the inner surface of the second panel, where the second color is different than the first color. The second peelable strip forms a plane generally opposing the first peelable strip, and the first color of the first peelable strip is visible through the second peelable strip when the first and second peelable strips are heat sealed to each other to form a peelable seal. The second color of the second peelable strip is substantially masking the first color of the first peelable strip when the peelable seal is broken.

In another implementation, a bag comprises first and second opposing films joined at a fold line and being perforated along the fold line. A first base strip has inner and outer surfaces, the outer surface of the first base strip is securably arranged with respect to an inner surface of the first film. A second base strip has inner and outer surfaces, and the second base strip forms a plane generally parallel to and opposing the first base strip. The outer surface of the second base strip is securably arranged with respect to an inner surface of the second film of a first color. A peelable strip of a second color is securably arranged with respect to the inner surface of the first base strip. The first color is different than the second color, and the second color of the peelable strip is visible through the second film when the peelable strip and the second film are heat sealed to each other to form a peelable seal. The first color of the second film substantially masks the second color of the peelable strip when the peelable seal is broken.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
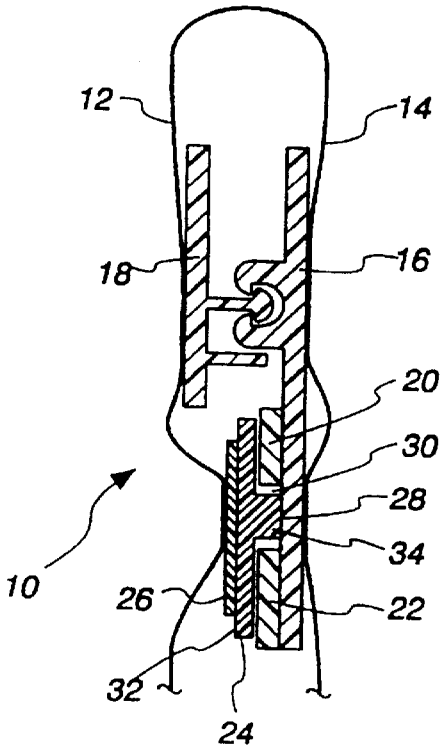
FIG. 1 is a sectional view of a closure arrangement of one embodiment of the present invention, showing a peelable seal prior to being broken.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE ILLUSTRATED EMBODIMENTS

Figure 2:
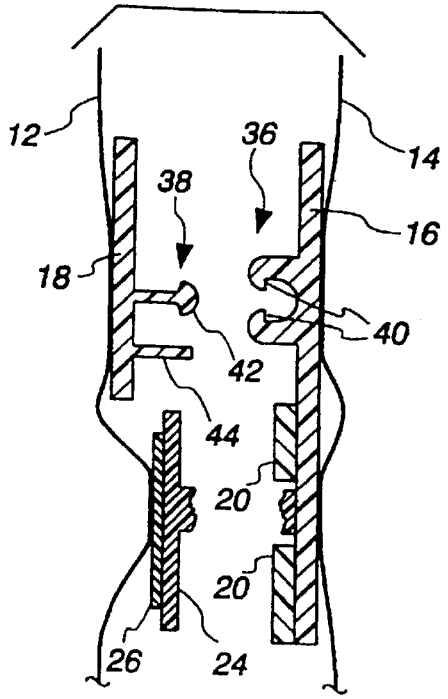
FIG. 2 is a sectional view of the closure arrangement in FIG. 1, showing the peelable seal after being broken.

FIGS. 1 and 2 illustrate a sectional view of a closure arrangement 10 for a reclosable bag having a top film 12 and a bottom film 14. The closure arrangement 10 includes a pair of flat base strips 16, 18, a pair of flat identical non-sealable strips 20, 22, a T-shaped peelable strip 24, and a sealant strip 26. The strips 16-26 are disposed at the mouth of the reclosable bag and extend along the length of the bag mouth. The top film 12 is heat-fused to both the base strip 18 and the sealant strip 26 and the bottom film 14 is heat-fused to the base strip 16 at preselected locations.

The strips 16–26 provide the closure arrangement 10 with a peelable seal at the location 28. The non-sealable strips 20, 22 are composed of a non-sealable (i.e., heat-resistant) material and are attached to the inner surface of the base strip 16. The non-sealable strips 20, 22 are positioned parallel to each other and are spaced from each other so as to form a gap 30 therebetween.

The T-shaped peelable strip 24 is composed of peelable material and includes a top portion 32 and a stem portion 34. The stem portion 34 is integrally formed with the top portion 32 and extends perpendicular to the center of the top portion 32. The stem portion 34 projects into the gap 30 between the non-sealable strips 20, 22, and the base of the stem portion 34 is attached to the inner surface of the base strip 16. The vertical dimension (as viewed in FIGS. 1 and 2) of the stem portion 34 is only slightly less than the size of the gap 30 so that the stem portion 34 occupies a substantial portion of the gap 30. Moreover, the horizontal dimension (as viewed in FIGS. 1 and 2) of the stem portion 34 is only slightly greater than the horizontal dimension of the non-sealable strips 20, 22 so that the inner (right) surface of the top portion 32 is immediately adjacent, but not attached, to the non-sealable strips 20, 22. The vertical dimension of the top portion 32 is slightly less than the combined vertical dimensions of the non-sealable strips 20, 22 and the gap 30 so that the top portion 32 is still separated from the base strip 16 at its extreme ends by the non-sealable strips 20, 22. The non-sealable strips 20, 22 ensure that the top portion 32 of the peelable strip 32 does not bond to the inner surface of the base strip 16 during production.

The sealant strip 26 is composed of low-temperature sealant material and is firmly attached to the outer (left) surface of the top portion 32 of the peelable strip 32. The vertical dimension of the sealant strip 26 is slightly less than the vertical dimension of the top portion 32. Since the sealant strip 26 bonds readily to other materials at low temperatures, the sealant strip 26 acts as a bridge for attaching the top film 12 to the top portion 32 of the peelable strip 24. Alternatively, the top film 12 may be heat-fused directly to the top portion 32 of the peelable strip 24 by use of higher temperatures, greater pressure, and/or greater dwell time of the seal bar during the heat sealing process.

To provide the closure arrangement 10 with a reclosable zipper, the base strips 16, 18 have integrally formed therewith respective female and male closure profiles 36, 38. The female closure profile 36 extends inwardly from the inner surface of the base strip 16 and includes a pair of flexible locking members 40 with hooks at the ends thereof. The male closure profile 38 extends inwardly from the inner surface of the base strip 18 and includes a single locking member 42 with an expanded head. The pair of locking members 40 are disposed opposite the single locking member 42 and are spaced by a sufficient distance that the expanded head of the single locking member 42 is releasably engageable between the pair of locking members 40. More specifically, the pair of locking members 40 interlock with the locking member 42 in a snapping action caused by bringing the hooks of the pair of locking members 40 passed the expanded head of the locking member 42. To facilitate alignment of the pair of locking members 40 with the locking member 42 during reclosure, the male closure profile 38 is provided with a guide post 44 for guiding one of the pair of locking members 40 between the guide post 44 and the locking member 42.

The closure arrangement 10 is manufactured using conventional extrusion and heat sealing techniques. In particular, the base strips 16, 18, the closure profiles 36, 38, the non-sealable strips 20, 22, the peelable strip 24, and the sealant strip 26 are co-extruded through a die plate fed by a plurality of extruders. These extruders carry the different molten materials for forming the strips 16–26 and the closure profiles 36, 38. As is well-known in the art, the die plate includes input ports, output ports, and channels connecting these input ports to output ports. The extruders feed the different molten materials to different input ports, and the channels are designed to configure the molten materials into the shapes of the strips 16-26 and the closure profiles 36, 38. The output ports are arranged such that the strips 16–26 and the closure profiles 36, 38 exit the die plate with the connections shown in FIG. 1. Since the base strip 18 and the closure profile 38 are separated from the base strip 16, the non-sealable strips 20, 22, the peelable strip 24, the sealant strip 26, and the closure profile 36, it should be apparent that these two separate sets of elements may be formed in separate extrusions using two different die plates.

After extruding the strips 16–26 and the closure profiles 36, 38, the top and bottom films 12, 14 are heat-fused using heated seal bars in the positions shown in FIG. 1. In particular, the top film 12 is heat-fused to the base strip 18 and the sealant strip 26, and the bottom film 14 is heat-fused to the base strip 16 at the illustrated positions. The vertical dimension (as viewed in FIG. 1) of the heat-fused positions is determined by the width of the seal bars applying pressure to the top and bottom films 12, 14.

Due to the interposition of the non-sealable strips 20, 22 between the top portion 32 of the peelable strip 24 and the base strip 16, the closure arrangement 10 accommodates wider seal bars for the above-mentioned heat sealing operations. If the seal bars transmit heat to the top portion 32 of the peelable strip 24, the non-sealable strips 20, 22 prevent the top portion 32 from fusing to the base strip 16 in response to this heat. The closure arrangement 10 is also relatively insusceptible to manufacturing variations. For example, the seal bar for fusing the top film 12 to the sealant strip 26 is aligned with the stem portion 34 of the peelable strip 24, and, similarly, the seal bar for fusing the bottom film 14 to the lower portion of the base strip 16 is aligned with the stem portion 34. If, however, these two seal bars are slightly misaligned relative to the stem portion 34, the non-sealable strips 20, 22 prevent the peelable strip 24 from forming any additional bonds to the base strip 16 than the bond formed between the stem portion 34 and the base strip 16.

As shown in FIG. 1, prior to initially opening a bag incorporating the closure arrangement 10, the peelable seal at the location 28 is intact, the closure profiles 36, 38 are interlocked with each other, and the top and bottom films 12, 14 are connected at the mouth end of the bag. The top and bottom films 12, 14 either are heat-fused together at the mouth end of the bag or are formed from a single piece of film. Since the peelable seal already provides a hermetic seal for the bag, the top and bottom films 12, 14 may alternatively be disconnected from each other at the mouth end.

To open the bag, the top and bottom films 12, 14 are separated from each other by cutting them apart. An alternate way of separating the films is discussed below, in conjunction with the description of FIGS. 25 and 26. Next, the interlocked closure profiles 36, 38 are detached from each other by grabbing onto the top and bottom films 12, 14 and pulling them apart. Finally, the peelable seal at the location 28 is broken by continuing to pull the top and bottom films 12, 14 in opposite directions. FIG. 2 illustrates the location 28 of the broken peelable seal as being within stem portion 34. Alternatively, the location 28 may be at the junction between the stem portion 34 and the base strip 16 so that breaking the peelable seal ruptures the bond between the stem portion 34 and the base strip 16.

The strength of the peelable seal is determined by the composition of the peelable material forming the peelable strip 24 and the size of the stem portion 34 of the peelable strip 24. With respect to the size of the stem portion 34, the larger the vertical dimension (as viewed in FIGS. 1 and 2) of the stem portion 34, the stronger the peelable seal. As explained in detail below, these variables are chosen such that the peelable seal has a strength ranging from two to six pounds per lineal inch.

Figure 3:
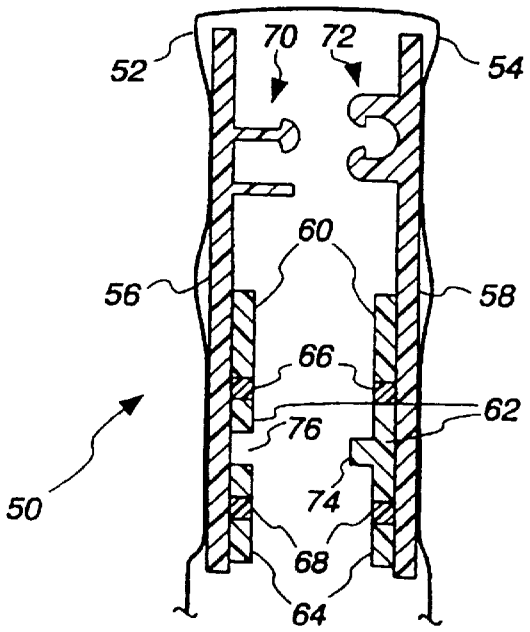
FIG. 3 is a sectional view of a closure arrangement of another embodiment of the present invention, showing a peelable seal prior to being formed (or after being broken)
Figure 4:
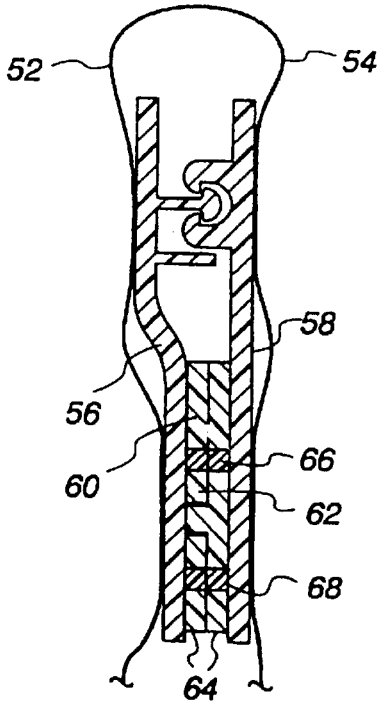
FIG. 4 is a sectional view of the closure arrangement in FIG. 3, showing the peelable seal after being formed and prior to being broken.

In accordance with another implementation of the present invention, FIGS. 3 and 4 illustrate a closure arrangement 50 for a polymeric bag having a top film 52 and a bottom film 54. The closure arrangement 50 includes a pair of flat base strips 56, 58, three pairs of opposing non-sealable strips 60, 62, 64, and two pairs of opposing peelable bands 66, 68. The top film 52 is firmly attached to the outer surface of the base strip 56, and the bottom film is firmly attached to the outer surface of the base strip 58. If desired, the base strips 56, 58 may be provided with a reclosable zipper with associated male and female closure profiles 70, 72.

As shown in FIGS. 3 and 4, one of the non-sealable strips in each of the three pairs of non-sealable strips 60, 62, and 64 is attached to the inner surface of the base strip 56, and the other of the non-sealable strips in each of these three pairs is attached to the inner surface of the base strip 58. The two non-sealable strips in each pair are aligned with each other. Moreover, the pair of non-sealable strips 60 is separated from the pair of non-sealable strips 62 by the pair of peelable bands 66, and the pair of non-sealable strips 62 is separated from the pair of non-sealable strips 64 by the pair of peelable bands 68.

These pairs of peelable bands 66, 68 are attached to both the base strips and adjacent non-sealable strips. In particular, one of the pair of peelable bands 66 is attached to both the inner surface of the base strip 56 and adjacent non-sealable strips of the pairs of non-sealable strips 60, 62. Similarly, the other of the pair of peelable bands 66 is attached to both the inner surface of the base strip 58 and adjacent non-sealable strips of the pairs of non-sealable strips 60, 62. The pair of peelable bands 68 is attached to the base strips and adjacent non-sealable strips in the same manner.

As shown in FIG. 4, the peelable bands in each pair of peelable bands are attached to each other to form individual peelable seals therebetween. Therefore, one peelable seal is formed between the pair of peelable bands 66, and another peelable seal is formed between the pair of peelable bands 68. The closure arrangement 50 is designed to facilitate control of the strength of the combined peelable seal formed from these individual peelable seals. The strength of the combined peelable seal is determined by the width of the peelable bands, the number of pairs of peelable bands, and the material composition of the peelable bands. The wider the peelable bands, the stronger the individual peelable seals and, therefore, the stronger the combined peelable seal. Also, the greater the number of pairs of peelable bands, the stronger the combined peelable seal. Although FIGS. 3 and 4 illustrate the closure arrangement 50 as including two pairs of peelable bands, the closure arrangement 50 may be modified to include only one pair of peelable bands or more than two pairs of peelable bands. In one implementation, the combined peelable seal formed from the individual peelable seals has a strength ranging from two to six pounds per lineal inch.

Like the closure arrangement 10 in FIGS. 1 and 2, the closure arrangement 50 is manufactured using conventional extrusion and heat sealing techniques. The base strips 56, 58, the three pairs of non-sealable strips 60, 62, and 64, the two pairs of peelable bands 66, 68, and the closure profiles 70, 72 are co-extruded with each other using a single die plate. If desired, however, separate die plates may be used to separately extrude the opposite sides of the closure arrangement 50.

After extruding the aforementioned elements of the closure arrangement 50, the top and bottom films 52, 54 are heat-fused to the respective base strips 56, 58 using heated seal bars. The heat from these seal bars penetrates through the closure arrangement 50 so as to simultaneously fuse the pair of peelable bands 66 to each other and fuse the pair of peelable bands 68 to each other. This heat fusion of opposing peelable bands creates the individual peelable seals. Since the pairs of non-sealable strips 60, 62, and 64 are composed of non-sealable material, they do not fuse to each other. The non-sealable strips render the closure arrangement 50 relatively insusceptible to small manufacturing variations by ensuring that no bonds are made aside from those described above.

To most efficiently use the peelable material provided by the pairs of peelable bands 66, 68 and achieve the desired strength for the combined peelable seal, each pair of peelable bands be properly aligned with each other during the heat sealing operation. In other words, the upper and lower ends of one peelable band should be aligned with the respective upper and lower ends of the opposing peelable band. To achieve this proper alignment, at least one of the pairs of non-sealable strips 60, 62, and 64 is provided with a projecting rib 74 on one non-sealable strip which mates with a gap 76 in the opposing non-sealable strip. In one implementation, this mating rib 74 and gap 76 are located on the central pair of non-sealable strips 62. While the rib 74 and gap 76 are illustrated as having the same horizontal dimension as the non-sealable strips so that the gap 76 essentially divides the associated non-sealable strip into two separate parts, it should be understood that the rib 74 and the gap 76 may be designed with smaller horizontal dimensions. Also, additional mating ribs and gaps may be provided on any of the three pairs of non-sealable strips 60, 62, and 64.

FIG. 4 illustrates the closure arrangement 50 after forming the individual peelable seals. To break the peelable seals, a user first cuts open the mouth end of the bag (or, alternatively, opens the bag along a perforation, described below in conjunction with FIGS. 25 and 26), grabs the top and bottom films 52, 54, and pulls the top and bottom films 52, 54 in opposite directions. After disengaging the interlocked closure profiles 70, 72 from each other, continued pulling of the bag films in opposite directions breaks the peelable seals. FIG. 3 illustrates the closure arrangement 50 after breaking the peelable seals.

Figure 5:
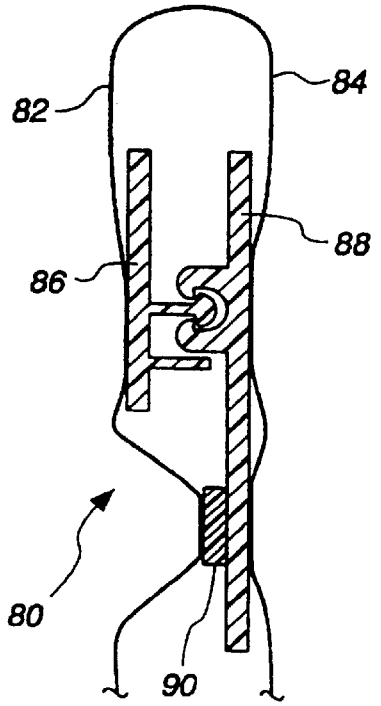
FIG. 5 is a sectional view of a closure arrangement of yet another embodiment of the present invention, showing a peelable seal prior to being broken.
Figure 6:
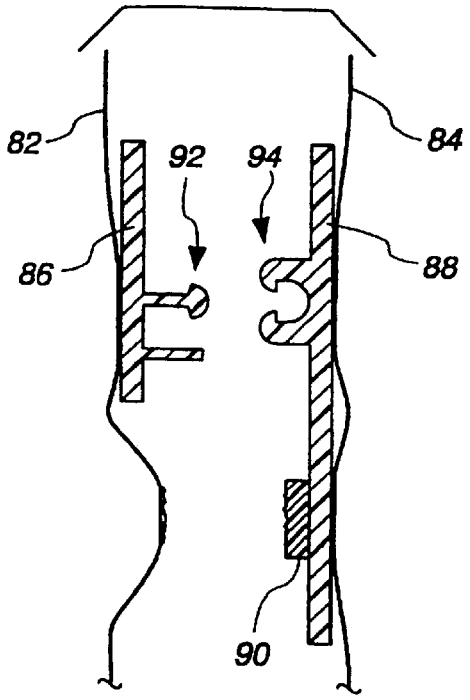
FIG. 6 is a sectional view of the closure arrangement in FIG. 5, showing the peelable seal after being broken.

In accordance with yet another implementation of the present invention, FIGS. 5 and 6 illustrate a closure arrangement 80 for a polymeric bag having a top film 82 and a bottom film 84. The closure arrangement 80 includes a pair of flat opposing base strips 86, 88 and a flat peelable strip 90. In addition, the closure arrangement 80 may be provided with a reclosable zipper having interlocking male and female closure profiles 92, 94. The closure arrangement 80 is disposed at the mouth of the reclosable bag and extends along the length of the bag mouth. The top film 82 is heat-fused to both the base strip 86 and the peelable strip 90. To accommodate the peelable strip 90, the base strip 88 is wider, i.e., has a longer vertical dimension, than the base strip 86. Due to this relatively large width of the base strip 88, the bottom film 84 is heat-fused to the base strip 88 at multiple locations along its width so as to provide a firm attachment therebetween. If desired, instead of attaching the bottom film 84 directly to the base strip 88, a sealant strip composed of low-temperature sealant material may be interposed between the bottom film 84 and the base strip 88.

One surface of the peelable strip 90 is firmly attached to the inner surface of the base strip 88 by co-extruding the peelable strip 90 with the base strip 88. If desired, a sealant strip may be interposed between the peelable strip 90 and the base strip 88. This sealant strip, however, is not necessary to provide an effective bond between the peelable strip 90 and the base strip 88. As illustrated in FIG. 5, the opposite surface of the peelable strip 90 is attached to the top film 82 to form a peelable seal. In an alternative implementation, the closure arrangement 80 includes additional peelable strips substantially identical to the peelable strip 90 and connected between the top film 82 and the base strip 88.

To manufacture the closure arrangement 80, the base strips 86, 88, the peelable strip 90, and the closure profiles 92, 94 are first co-extruded with each other through a single die plate. Alternatively, the base strip 86 and the male closure profile 92 may be extruded through one die plate, while the base strip 88, the peelable strip 90, and the female closure profile 94 are extruded through another die plate. As previously described, the top- and bottom films 82, 84 are then fused, using heated seal bars, to the extruded elements to form the closure arrangement 80. As depicted in FIG. 6, the peelable seal between the peelable strip 90 and the top film 82 is broken by cutting open the bag mouth (or, alternatively, by breaking a perforation, as described below with respect to FIGS. 25 and 26), disengaging the interlocked closure profiles 92, 94 from each other, and pulling the bag films 82, 84 is opposite directions.

One advantage of the closure arrangement 80 is that it facilitates control of the strength of the peelable seal formed between the top film 82 and the peelable strip 90. This control is due to the fact that the heat used to form the peelable seal only must penetrate through the top film 82, as opposed to the top film 82 along with other layers of material. By minimizing the layers of material through which the heat must penetrate to form the peelable seal, it is relatively easy to determine the required pressure, temperature, and dwell time of the heated seal bar in order to produce a peelable seal having a strength ranging from two to six pounds per lineal inch. In addition, one or more of the foregoing three variables of the heated seal bar may be reduced to compensate for the shorter path of heat penetration associated with the closure arrangement 80.

Another advantage of the closure arrangement 80 is that the peelable seal is located between the top film 82 and the peelable strip 90, as opposed to being located within multiple layers of material positioned between the top and bottom films 82, 84. By minimizing the number of material layers for forming the peelable seal, the closure arrangement 80 is both simple and effective.

In accordance with another implementation of the present invention, FIGS. 7 and 8 and FIGS. 11 and 12 illustrate a closure arrangement 100 for a polymeric bag having a top film 102 and a bottom film 114. The closure arrangement 100 includes a pair of flat opposing base strips 106, 108, a flat peelable strip 110, a flat sealant strip 112, and one or more sealant ribs 114 in FIGS. 7 and 8 or 114A in FIGS. 11 and 12. In one implementation, the closure arrangement 100 also includes a reclosable zipper having interlocking male and female closure profiles 116, 118. This reclosable zipper is substantially identical in structure and operation to the reclosable zipper described in connection with FIGS. 1 and 2.

The top and bottom films 102, 104 are firmly attached to the outer surfaces of the respective base strips 106, 108. The flat peelable strip 110 is firmly attached to the inner surface of the base strip 108 using the sealant strip 112. The sealant strip 112 provides a strong bond between the peelable strip 110 and the base strip 108 and insures that the peelable strip 110 remains attached to the base strip 108 following breakage of the peelable seals formed by the closure arrangement 100. Alternatively, however, the peelable strip 110 may be attached directly to the inner surface of the base strip 108.

Figure 7:
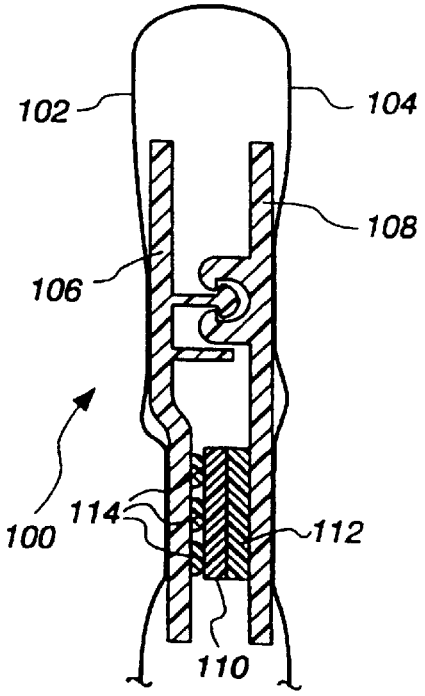
FIG. 7 is a sectional view of a closure arrangement of a further embodiment of the present invention, showing a peelable seal of a breakaway type prior to being broken.
Figure 8:
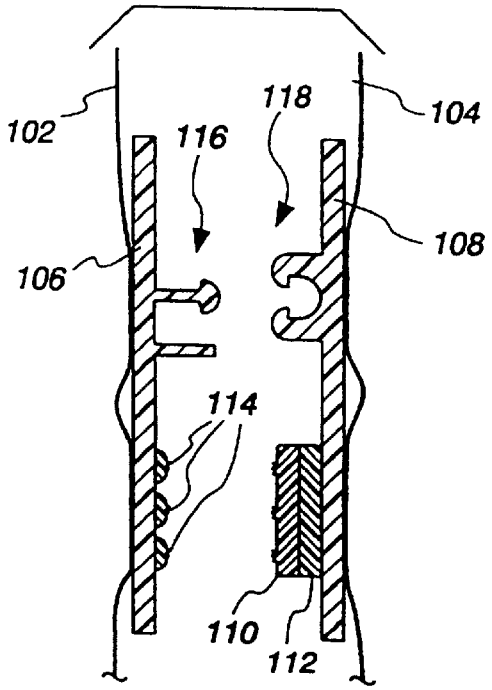
FIG. 8 is a sectional view of the closure arrangement in FIG. 7, showing the peelable seal after being broken.
Figure 11:
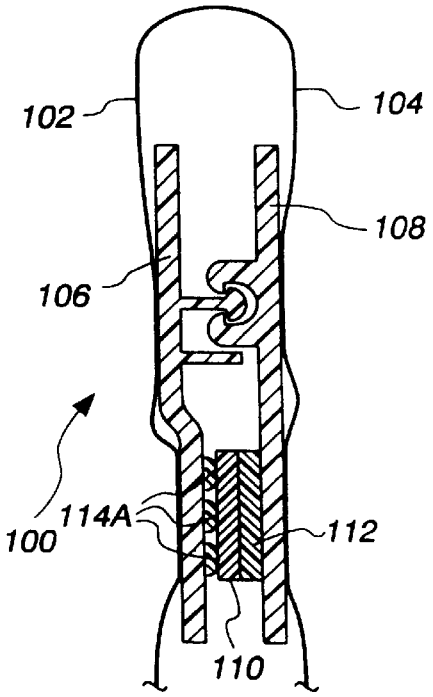
FIG. 11 is a sectional view of a closure arrangement similar to that of FIG. 7, but illustrating a peelable seal of the peel seal type rather than a breakaway seal, prior to being broken.
Figure 12:
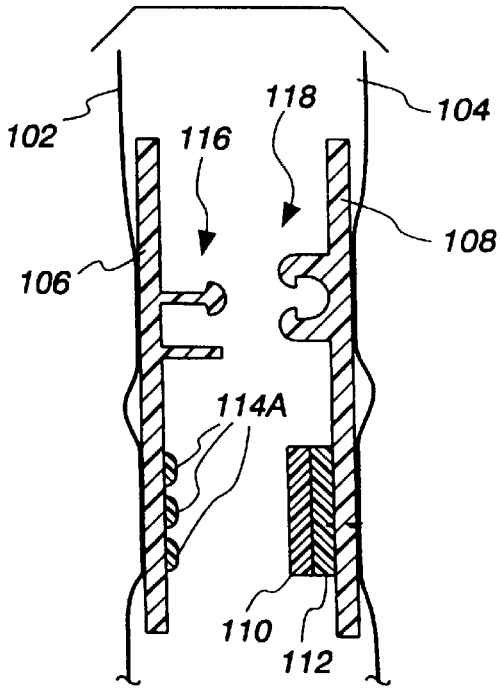
FIG. 12 is a sectional view of the closure arrangement in FIG. 11, showing the peelable seal after being broken.

The sealant ribs 114 or 114A are firmly attached to the inner surface of the base strip 106 and are detachably connected to the inner surface of the peelable strip 110 (FIGS. 7 and 11). The sealant ribs 114 in FIGS. 7 and 8 are formed of a material having a tear strength which is less than the bond strength between the sealant ribs 114 and the peelable strip 110 and the bond strength between the sealant ribs 114 and the base 106 such that upon breakage of the peelable seal the sealant ribs 114 rupture internally, resulting in a portion of the ribs 114 remaining attached to base 106 and a portion of the sealant ribs attached to peelable strip 110, as shown in FIG. 8. An individual peelable seal of the breakaway type is formed between each of the sealant ribs 114 and the inner surface of the peelable strip 110 so as to form a combined peelable seal. The sealant ribs 114A in FIGS. 11 and 12 are formed of a material having a tear strength greater than the bond strength between the sealant ribs 114A and the base 106 and greater than the bond strength between the sealant ribs and the peelable step 110. In addition, the bond strength of the sealant ribs 114A to the base 106 exceeds the bond strength of the sealant ribs 114A to the peelable strip 110, such that upon breakage of the peelable seal the sealant ribs 114A detach from the peelable strip 110 resulting in a peelable seal of the peel seal type with none of the sealant ribs 114A remaining attached to the peelable strip 110, as shown in FIG. 12. Like the closure arrangement 50 in FIGS. 3 and 4, the closure arrangement 100 is designed to facilitate control of the strength of the combined peelable seal. The strength of the combined peelable seal is determined in part by the width of the sealant ribs 114 or 114A and the number of sealant ribs 114 or 114A. The wider the sealant ribs 114 or 114A, the stronger the individual peelable seals and, therefore, the stronger the combined peelable seal. To insure that breakage of the individual peelable seals occurs approximately at the locations shown in FIGS. 8 and 12 and does not cause the peelable strip 110 to disengage from the sealant strip 112, sealant ribs 114 or 114A should be relatively narrow compared to the peelable strip 110.

The greater the number of sealant ribs 114 or 114A, the stronger the combined peelable seal. Although FIGS. 7, 8, 11, and 12 illustrate the closure arrangement 100 as including three sealant ribs 114 or 114A, the closure arrangement 100 may be modified to include as few as one sealant rib 114 or 114A or more than three sealant ribs 114 or 114A. In one implementation, the combined peelable seal formed from the individual peelable seals has a strength ranging from two to six pounds per lineal inch.

The closure arrangement 100 is manufactured using conventional extrusion and heat sealing techniques. The base strips 106, 108, the peelable strip 110, the sealant strip 112, the sealant ribs 114 or 114A, and the closure profiles 116, 118 are co-extruded with each other using a single die plate. If desired, however, separate die plates may be employed to separately extrude the opposite sides of the closure arrangement 100. Using separate die plates, one die plate is used to extrude the base strip 106, the sealant ribs 114, and the male closure profile 116, and another die plate is used to extrude the base strip 108, the peelable strip 110, the sealant strip 112, and the female closure profile 118.

Following the foregoing extrusion operation, the top and bottom films 102, 104 are heat-fused to the respective base strips 106, 108 using heated seal bars. The heat from these seal bars penetrates through the closure arrangement 100 so as to simultaneously fuse the sealant ribs 114 or 114A to the peelable strip 110 and create the peelable seals therebetween. The pressure, temperature, and dwell time of the seal bars are adjusted such that the combined peelable seal has a strength ranging from two to six pounds per lineal inch. A significant advantage of the closure arrangement 100 is that it has a relatively large manufacturing tolerance. Small variations in the pressure, temperature, or dwell time of the seal bars do not cause significant variations in the strength of the peelable seals. As a result, the closure arrangement 100 is relatively insusceptible to such manufacturing variations.

FIGS. 7 and 11 illustrate the closure arrangement 100 prior to breaking the peelable seals, and FIGS. 8 and 12 illustrate the closure arrangement after breaking the peelable seals. It can be seen from FIG. 8 that breaking the breakaway peelable seals causes the sealant ribs 114 to rupture internally and from FIG. 12 that breaking the peel seal peelable seals causes the sealant ribs 114A to detach from the peelable strip 110.

Figure 9:
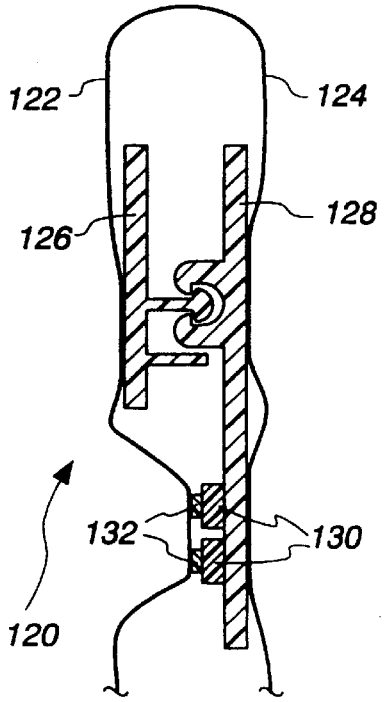
FIG. 9 is a sectional view of a closure arrangement of yet a further embodiment of the present invention, showing a peelable seal prior to being broken.
Figure 10:
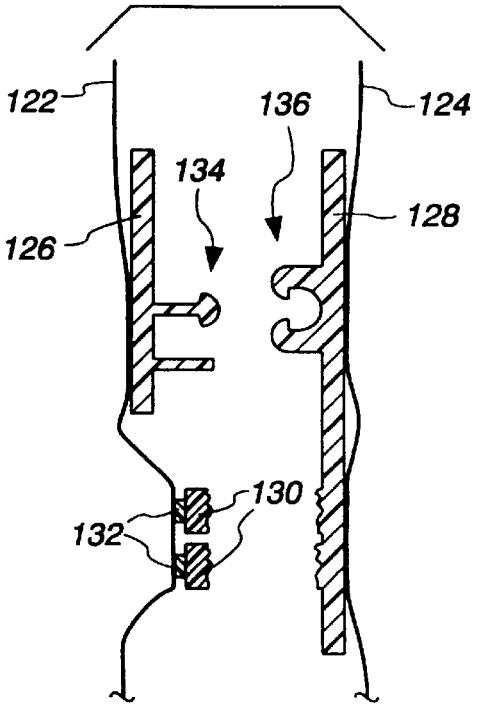
FIG. 10 is a sectional view of the closure arrangement in FIG. 9, showing the peelable seal after being broken.

In another implementation, FIGS. 9 and 10 illustrate a closure arrangement 120 for a polymeric bag having a pair of opposing films 122, 124. The closure arrangement 120 includes a pair of opposing base strips 126, 128, a pair of adjacent peelable bands 130, and a pair of sealant bands 132. In one implementation, the closure arrangement 120 further includes interlocking male and female closure profiles 134, 136 integrally formed with the respective base strips 126, 128.

The films 122, 124 are firmly attached to the outer surfaces of the respective base strips 126, 128. The pair of peelable bands 130 are spaced a short distance from each other and are detachably connected to the inner surface of the base strip 128. These two connections between the peelable bands 130 and the inner surface of the base strip 128 form a pair of individual peelable seals. The pair of sealant bands 132, in turn, are firmly attached to both the inner surfaces of the pair of peelable bands 130 and the inner surface of the top film 122. The sealant bands 132 are narrower, i.e., have a smaller vertical dimension, than the peelable bands 130. To accommodate the connections between the sealant bands 132 and the top film 122, the base strip 126 has a shorter vertical dimension than the base strip 128. Therefore, an upper portion of the base strip 128 opposes the base strip 126, while a lower portion of the base strip 128 carrying the sealant bands 132 opposes the top film 122 without interference from the base strip 126.

The bond between the sealant bands 132 and the top film 122 and the bond between the sealant bands 132 and the peelable bands 130 are stronger than the bond between the peelable bands 130 and the base strip 128. As a result, the peelable seals are located between the peelable bands 130 and the base strip 128. When the two sides of the closure arrangement 120 are pulled apart, the bond between the peelable bands 130 and the base strip 128 breaks first, as illustrated in FIG. 10. The sealant bands 132 and the peelable bands 130 remain attached to the top film 122.

The closure arrangement 120 is designed to facilitate control of the strength of the combined peelable seal formed from the two individual peelable seals. The strength of the combined peelable seal is determined in part by the width of the peelable bands 130 and the number of peelable bands 130. The wider the peelable bands 130, the stronger the individual peelable seals and, therefore, the stronger the combined peelable seal. Furthermore, the greater the number of peelable bands 130, the stronger the combined peelable seal. Although FIGS. 9 and 10 illustrate the closure arrangement 120 as including a pair of peelable bands 130 and a pair of sealant bands 132 attached thereto, the closure arrangement 120 may be modified to include as few as one peelable band 130 with a sealant band 132 attached thereto or more than two peelable bands 130 with respective sealant bands 132 attached thereto. In one implementation, the combined peelable seal formed from the individual peelable seals has a strength ranging from two to six pounds per lineal inch.

The closure arrangement 120 is manufactured using conventional extrusion and heat sealing techniques. In particular, the pair of base strips 126, 128, the pair of peelable bands 130, the pair of sealant bands 132, and the interlocking closure profiles 134, 136 are co-extruded through a single die plate fed by a plurality of extruders. Alternatively, the base strip 126 and the male closure profile 134 are extruded through one die plate, and the base strip 128, the pair of peelable bands 130, the pair of sealant bands 132, and the female closure profile 136 are extruded through another die plate. Following this extrusion operation, the top and bottom films 122, 124 are fused using heated seal bars to the outer surfaces of the respective base strips 126, 128. Also, the top film 122 is fused to the sealant bands 132.

The compositions of the various portions of the closure arrangements in FIGS. 1–12 are described below. More specifically, the peelable material used to form the peelable strips and bands in the closure arrangements is a mixture of four components. First, the peelable material includes a low density polyethylene such as Product No. 412FA manufactured by Westlake Polymers Corp. of Lake Charles, La. Second, the peelable material includes a mineral-reinforcement concentrate such as HM10 manufactured by Heritage Plastics Inc. of Picayune, Miss. Third, the peelable material includes ethylene vinyl acetate (EVA) such as ESCORENE7 manufactured by Exxon Chemical Co. of Baytown, Tex. Finally, the peelable material includes polybutylene such as Shell 1560 manufactured by Shell Oil Co. of Houston, Tex. The weight percentages of the foregoing four components of the peelable material are 30% low density polyethylene, 30% mineral-reinforcement concentrate, 20% ethylene vinyl acetate, and 20% polybutylene. The foregoing mixture allows the peelable material to achieve its desired characteristics, which include (1) the ability to provide a bond strength between two and six pounds per lineal inch, and (2) the ability to be heat sealed to another material using a heated seal bar having a temperature ranging from 300 EF to 400 EF and a dwell time ranging from 0.3 to 0.7 seconds.

The sealant material used to form the sealant strips, bands, and ribs in the closure arrangements is a mixture of low density polyethylene and ethylene vinyl acetate, such as VE 652059 manufactured by Quantum Chemical Corp. of Cincinnati, Ohio. This mixture allows the sealant material to seal at lower temperatures than low density polyethylene by providing the sealant material with a melting point ranging from 175 EF to 205 EF.

The base material used to form the base strips is composed of a mixture of two components. First, the base material includes a low density polyethylene such as Product No. 412FA manufactured by Westlake Polymers Corp. of Lake Charles, La. Second, the base material includes ethylene vinyl acetate such as ESCORENE7 manufactured by Exxon Chemical Co. of Baytown, Tex. The weight percentages are 90% low density polyethylene and 10% ethylene vinyl acetate. Alternatively, the base material may be composed of Rexene 1206 manufactured by Rexene Corporation of Odessa, Tex. The primary characteristics of the base material are that it bonds readily to both peelable material and sealant material and it provides a modicum of thermal resistance so that it does not melt while bonding other materials thereto.

The non-sealable material used to form the non-sealable strips of the closure arrangements in FIGS. 1–12 is a heat-resistant material such as polypropylene, nylon, or high density polyethylene.

The top and bottom films of the polymeric bags containing the closure arrangements are composed of two or more layers of material. The outer layer of material is a heat-resistant material such as polyestradiol phosphate (PEP), oriented polypropylene, or biaxially-oriented nylon. The inner layer of material is a sealant material such as a combination of low density polyethylene and ethylene vinyl acetate. A significant advantage of the closure arrangements in FIGS. 1–10 is that they do not form peelable seals within the bag film itself. Instead, the peelable seals are formed at some location between the top and bottom films. For example, in FIGS. 1–2, the peelable seal is located within the stem portion 34 of the peelable strip 24. The various layers of material from which the bag film is formed remain intact at all times. Since the peelable seals are not formed within the bag film, the bag film may be produced from relatively inexpensive materials, such as those described above.

During manufacture of the closure arrangements in FIGS. 1–12, the various bonds or attachments between different materials are formed such that the weakest bond is formed at the location of the peelable seal. By forming the weakest bond at the location of the peelable seal, the application of opening forces to the closure arrangement will cause the peelable seal to rupture first. Since the other bonds are stronger than the peelable seal, these other bonds will not rupture in response to the application of opening forces. As previously stated, the peelable seal in each of the closure arrangements has a strength ranging from two to six pounds per lineal inch. This lineal inch is measured along the length of the peelable seal, i.e., perpendicular to the plane of the page in FIGS. 1–12 at the location of the peelable seal. The inventor has discovered that a peelable seal strength within this range allows the peelable seal to hermetically seal the associated bag and, at the same time, allows the peelable seal to be quickly and easily broken.

All other bonds between different materials, including those formed by extrusion and those formed by heat fusion, have a strength of at least ten pounds per lineal inch. This difference in bond strength between the peelable seal and all other bonds insures that only the peelable seal will break in response to opening the closure arrangement.

Since the peelable seals of the closure arrangements in FIGS. 1–12 are relatively insusceptible to manufacturing variations, they are consistent in strength from one bag to the next. In addition, they break in a consistent manner from one bag to the next. To provide evidence of tampering, breaking the peelable seal of each of the closure arrangements causes the peelable seal to undergo a change in texture or appearance. This change in texture or appearance provides the consumer with a visual indication that the peelable seal has been broken.

Figure 13:
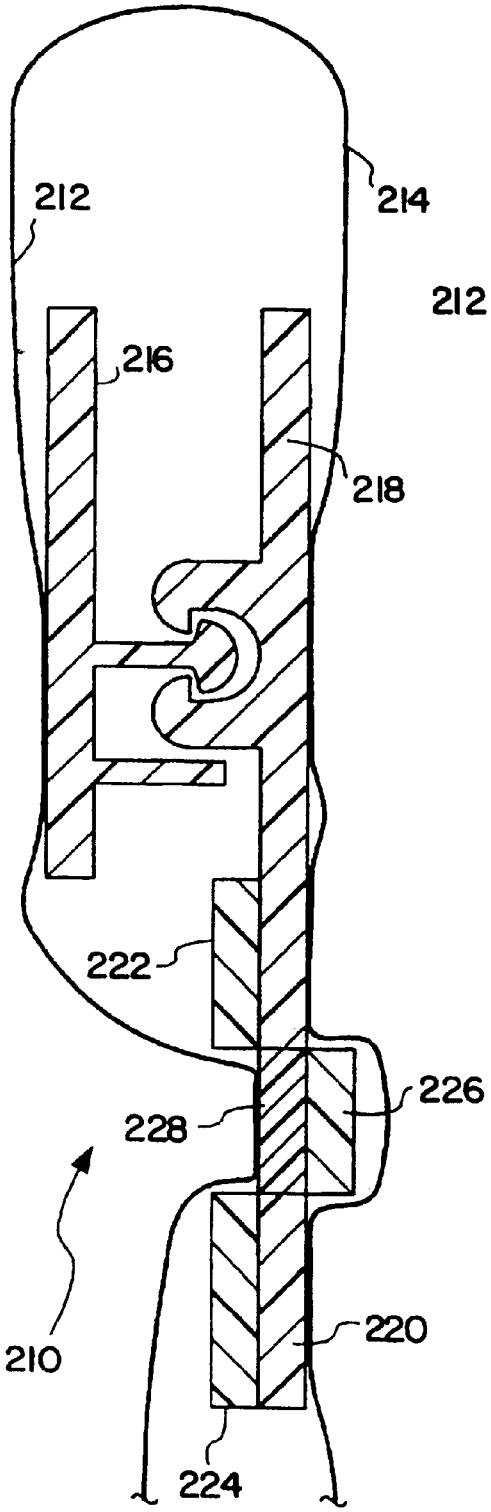
FIG. 13 is a sectional view of a further embodiment of the present invention, showing a breakaway seal prior to being broken.
Figure 14:
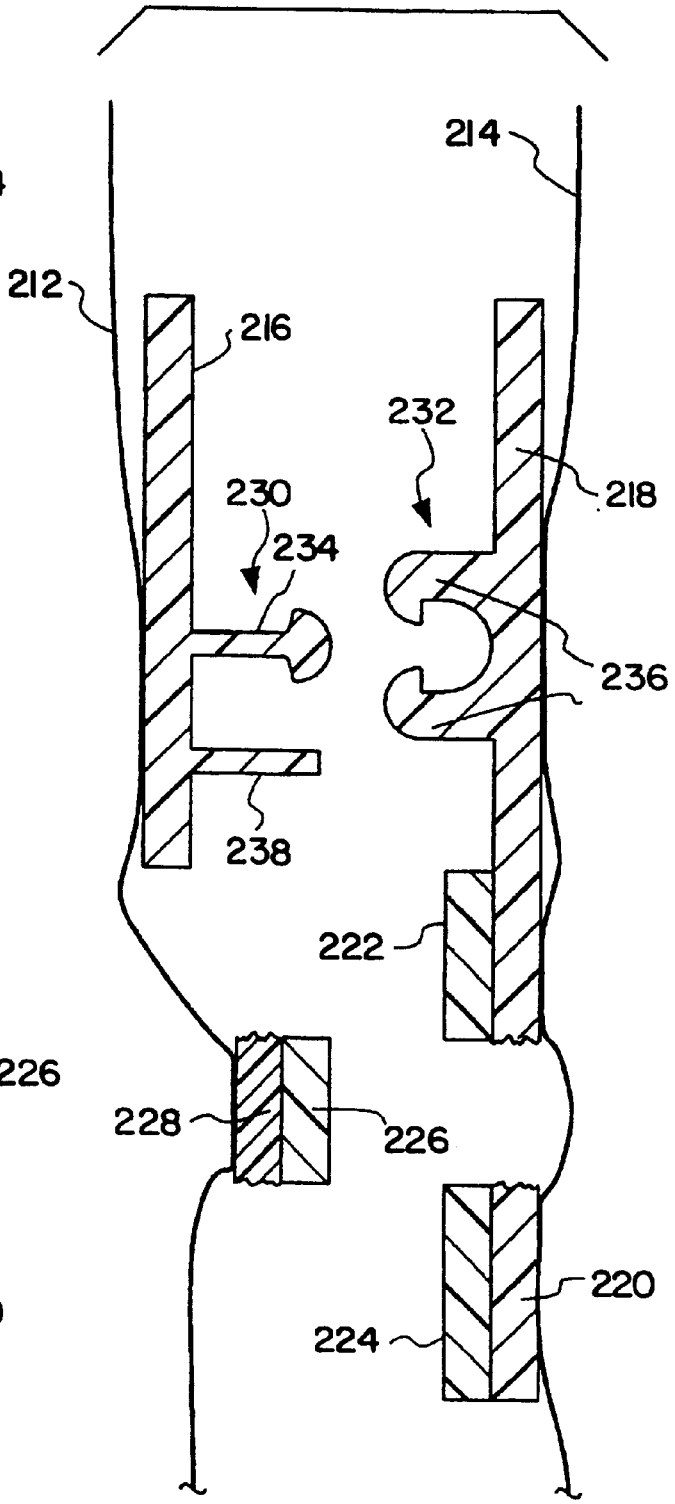
FIG. 14 is a sectional view of the closure arrangement in FIG. 13, showing the breakaway seal after being broken.

FIGS. 13 and 14 illustrate a sectional view of another implementation of a closure arrangement 210 for a reclosable bag having a top film 212 and a bottom film 214. The closure arrangement 210 includes a plurality of flat base strips 216, 218, and 220, a plurality of flat non-sealant stripes 222, 224, and 226, and a flat breakaway strip 228. The strips 216–228 are disposed at the mouth of the reclosable bag and extend along the length of the bag mouth. Moreover, the strips 216–228 are parallel to each other along the length of the bag mouth. The top film 212 is heat-fused to the outer surface of the base strip 216 and to the breakaway strip 228, while the bottom film 214 is heat-fused to the outer surfaces of the base strip 218 and the base strip 220.

The base strips 218, 220 have approximately the same thickness, are co-planar with each other, and are laterally spaced from each other by a distance equivalent to the width of the breakaway strip 228. As viewed in FIGS. 13 and 14, the width of the breakaway strip 228 is equal to the vertical dimension thereof. An upper flange portion of the base strip 218 directly opposes the base strip 216.

To provide the closure arrangement 210 with a reclosable zipper, the base strips 216, 218 have integrally formed therewith respective male and female closure profiles 230, 232. The male closure profile 230 extends inwardly from the inner surface of the base strip 216 and includes a single locking member 234 with an expanded head. The female closure profile 232 extends inwardly from the upper flange portion of the base strip 218 and includes a pair of flexible locking members 236 with hooks at the ends thereof. The pair of locking members 236 are disposed opposite the single locking member 234 and are spaced by a sufficient distance that the expanded head of the single locking member 234 is releasably engageable between the pair of locking members 236. More specifically, the pair of locking members 236 interlock with the locking member 234 in a snapping action caused by bringing the hooks of the pair of locking members 236 past the expanded head of the locking member 234. To facilitate alignment of the pair of locking members 236 with the locking member 34 during reclosure, the male closure profile 230 is provided with a guide post 238 for guiding one of the pair of locking members 236 between the guide post 238 and the locking member 234. In an alternative implementation, the closure arrangement 210 is designed without a reclosable zipper.

The breakaway strip 228 has approximately the same thickness of the base strips 218, 220 and is co-planar with the base strips 218, 220. However, if desired to provide varying breakaway properties, the breakaway strip 228 may have a thickness substantially greater than or substantially less than the base strips 218, 220. The breakaway strip 228 is disposed between the spaced base strips 218, 220 and is releasably engaged thereto so as to form breakaway seals at the junctions between the breakaway strip 228 and the respective base strips 218, 220. More specifically, an upper side of the breakaway strip 228 is detachably connected to the base strip 218 to form a first breakaway seal and the opposing lower side of the breakaway strip 228 is detachably connected to the base strip 220 to form a second breakaway seal. To permit these breakaway seals to be broken as depicted in FIG. 14, the inner surface of the breakaway strip 28 is directly attached to the top film 212.

In an alternative implementation, the breakaway strip 228 is attached to the top film 212 using a sealant strip disposed therebetween. Since the sealant strip bonds readily to other materials at low temperatures, the sealant strip acts as a bridge for attaching the top film 212 to the breakaway strip 228. The sealant strip is a mixture of low density polyethylene and ethylene vinyl acetate, such as VE 652059 manufactured by Quantum Chemical Corp. of Cincinnati, Ohio. This mixture allows the sealant material to seal at lower temperatures than low density polyethylene by providing the sealant material with a melting point ranging from 175° F. to 205° F.

In second alternative implementation, the base strip 220 and non-sealant strip 224 are eliminated. In this implementation, the breakaway strip 228 is detachably connected only to base strip 218.

The non-sealable strips 222, 224, and 226 are composed of a heat-resistant material. The non-sealable strips 222, 224 insure that the top film 212 is only fused to the breakaway strip 228 by preventing attachment of the top film 212 to adjacent portions of the base strips 218, 220. The non-sealable strip 222 is attached to the inner surface of the base strip 218 adjacent the upper side of the breakaway strip 228, while the non-sealable strip 224 is attached to the inner surface of the base strip 220 adjacent the lower side of the breakaway strip 228. The non-sealable strip 226 insures that the bottom film 214 is only fused to the base strips 218, 220 by preventing attachment of the base film 214 to the breakaway strip 228. The non-sealable strip 226 is disposed between the outer surface of the breakaway strip 228 and the bottom film 214 and is attached to the outer surface of the breakaway strip 228. In the implementation where strips 220 and 224 are not present, top film 212 and bottom film 214 are prevented from fusing by the use of seal bars that do not protrude below breakaway strip 228.

As shown in FIG. 13, prior to initially opening a bag incorporating the closure arrangement 210, the breakaway seals are intact, the closure profiles 230, 232 are interlocked with each other, and the top and bottom films 212, 214 are connected at the mouth end of the bag. The top and bottom films 212, 214 either are heat-fused together at the mouth end of the bag or are formed from a single piece of film. Since the breakaway seals between the breakaway strip 228 and the base strips 218, 220 already provide a hermetic seal for the bag, the top and bottom films 212, 214 may alternatively be disconnected from each other at the mouth end.

To open the bag, the top and bottom films 212, 214 are separated from each other by cutting them apart. Alternatively, the top and bottom films 212, 214 are separated by ripping along a perforated line, described below with respect to FIGS. 25 and 26. Next, the interlocked closure profiles 230, 232 are detached from each other by grabbing onto the top and bottom films 212, 214 and pulling them apart. Finally, the breakaway seals between the breakaway strip 228 and the base strips 218, 220 are broken by continuing to pull the top and bottom films 212, 214 in opposite directions. During breakage of these breakaway seals, the base strip 216 and the breakaway strip 228 remain attached to the top film 212, while the base strips 218, 220 remain attached to the bottom film 214.

The closure arrangement 210 is manufactured using conventional extrusion and heat sealing techniques. In particular, the base strips 216, 218, and 220, the closure profiles 230, 232, the non-sealable strips 222, 224, and 226, and the breakaway strip 228 are co-extruded through a die plate fed by a plurality of extruders. These extruders carry the different molten materials for forming the strips 216–228 and the closure profiles 230, 232. As is well-known in the art, the die plate includes input ports, output ports, and channels connecting these input ports to output ports. The extruders feed the different molten materials to different input ports, and the channels are designed to configure the molten materials into the shapes of the strips 216–228 and the closure profiles 230, 232. The output ports are arranged such that the strips 216–228 and the closure profiles 230, 232 exit the die plate with the connections shown in FIG. 13. Since the base strip 216 and the male closure profile 230 are separated from the base strips 218, 220, the non-sealable strips 222, 224, and 226, the breakaway strip 228, and the female closure profile 232, it should be apparent that these two separate sets of elements may be formed in separate extrusions using two different die plates.

After extruding the strips 216–228 and the closure profiles 230, 232, the top and bottom films 212, 214 are heat-fused using heated seal bars in the positions shown in FIG. 13. In particular, the top film 212 is heat-fused to the base strip 216 and the breakaway strip 228, and the bottom film 214 is heat-fused to the base strips 218, 220 at the illustrated positions. The vertical dimension (as viewed in FIG. 13) of the heat-fused positions is determined by the width of the seal bars applying pressure to the top and bottom films 212, 214.

Due to the interposition of the non-sealable strips 222, 224 between the top film 212 and the respective base strips 218, 220 at locations adjacent the breakaway strip 228, the closure arrangement 210 accommodates a wider seal bar for fusing the top film 212 to the breakaway strip 228. Although the wider seal bar may increase the temperature of the top film 212 and the base strips 218, 220 at locations adjacent the breakaway seal 228, the non-sealable strips 222, 224 prevent the top film 212 from improperly fusing to the inner surfaces of the base strips 218, 220 at these locations. Similarly, the interposition of the non-sealant strip 226 between the breakaway strip 228 and the bottom film 214 allows the application of heat to the bottom film 214 at locations immediately adjacent the breakaway strip 228 without improperly fusing the bottom film 214 to the breakaway strip 228.

The closure arrangement 210 is also relatively insusceptible to slightly misaligned seal bars during production. For example, the seal bar for fusing the top film 212 to the breakaway strip 228 should be centrally aligned with the breakaway strip 228, and the seal bars for fusing the bottom film 214 to the base strips 218, 220 should contact the base film 214 at locations slightly above and slightly below the breakaway strip 228. If, however, these seal bars are slightly misaligned relative to the contact locations, the non-sealable strips 222, 224 prevent the top film 212 from forming any bonds to the base strips 218, 220 and the non-sealable strip 226 prevents the bottom film 214 from forming any bond to the breakaway strip 228.

During manufacture of the closure arrangement 210, the various bonds or attachments between different materials are formed such that the weakest bond is formed at the locations of the breakaway seals. By forming the weakest bond at the locations of the breakaway seals, the application of opening forces to the closure arrangement 210 will cause the breakaway seals to rupture first. Since the other bonds are stronger than the breakaway seal, these other bonds will not rupture in response to the application of opening forces.

The closure arrangement 210 is designed to facilitate control of the strength of the breakaway seals formed between the breakaway strip 228 and the respective base strips 218, 220. In particular, the strength of the breakaway seals is primarily determined by the composition of the materials forming the base strips 218 and 220 and the breakaway strip 228 and the thickness of both the breakaway strip 228 and the base strips 218, 220. The thicker the breakaway strip 228 and the base strips 218, 220, the larger the horizontal dimension (as viewed in FIGS. 13 and 14) of the breakaway seals and, therefore, the stronger the breakaway seals. In one implementation, the breakaway seals have a combined strength ranging from about two to about six pounds per lineal inch. This lineal inch is measured along the length of the breakaway seals, i.e., perpendicular to the plane of FIGS. 13 and 14 at the location of the breakaway seals. It has been discovered that a seal strength within this range allows the breakaway seals to hermetically seal the associated bag and, at the same time, allows the breakaway seals to be quickly and easily broken.

All other bonds which are stressed while breaking the breakaway seals have a strength of at least about ten pounds per lineal inch. These stressed bonds are those which involve the top and bottom films 212, 214; namely, the bond between the top film 212 and the base strip 216, the bond between the top film 212 and the breakaway strip 228, the bond between the bottom film 214 and the base strip 218, and the bond between the bottom film 214 and the base strip 220. This difference in bond strength between the breakaway seals and the aforementioned stressed bonds insures that only the breakaway seals will break in response to opening the closure arrangement 210.

As described above, the breakaway seals between the breakaway strip 228 and the base strips 218, 220 are formed by co-extruding the breakaway strip 228 with the base strips 218, 220, as opposed to being formed during the heat sealing operation. As a result, the temperature, pressure, and dwell time of the heated seal bars have minimal effect upon the formation and strength of the breakaway seals. This, in turn, makes the breakaway seals relatively insusceptible to small variations in the temperature, pressure, and dwell time of the heated seal bars during the heat sealing operation.

Thus, the breakaway seals are consistent in strength from one bag to the next. In addition, they break in a consistent manner from one bag to the next. To provide evidence of tampering, breaking the breakaway seals of the closure arrangement 210 causes the breakaway seals to undergo a change in texture or appearance. This change in texture or appearance provides the consumer with a visual indication that the breakaway seals have been broken.

Compositions of the various strips of the closure arrangement 210 are described below. The materials used to create the breakaway seal rely on a property of the co-extrusion process. When materials are co-extruded, their interface forms a bond that is lower in strength than the materials themselves due to incompatibility of the materials being co-extruded. Thus, by co-extruding the base strips 218 and 220 of a first material and the breakaway strip 228 of a second material, the bond along the lines between base strip 218 and breakaway strip 228 and between base strip 220 and breakaway strip 228 are weaker than any of the materials forming base strips 218 and 220 and breakaway strip 228.

The breakaway strip 228 is formed from a mixture of four components. First, the breakaway material includes a low density polyethylene, such as Product No. 412FA manufactured by Westlake Polymers Corp. of Lake Charles, La. Second, the breakaway material includes a mineral-reinforcement concentrate, such as HM10 manufactured by Heritage Plastics Inc. of Picayune, Miss. Third, the breakaway material includes ethylene vinyl acetate (EVA), such as ESCORENE7 manufactured by Exxon Chemical Co. of Baytown, Tex. Finally, the breakaway material includes polybutylene, such as Shell 1560 manufactured by Shell Oil Co. of Houston, Tex. The weight percentages of the foregoing four components of the breakaway material are 30% low density polyethylene, 30% mineral-reinforcement concentrate, 20% ethylene vinyl acetate, and 20% polybutylene. The foregoing mixture allows the breakaway material to achieve its desired characteristics, which include (1) the ability to provide a bond strength between two and six pounds per linear inch, and (2) the ability to be heat sealed to the top film 12 using a heated seal bar having a temperature ranging from about 300° F. to 400° F. and a dwell time ranging from about 0.3 to 0.7 seconds.

The base material used to form the base strips 216 and 220 and the closure profiles 230, 232 is composed of a mixture of two components. First, the base material includes a low density polyethylene, such as Product No. 412FA manufactured by Westlake Polymers Corp. of Lake Charles, La. Second, the base material includes ethylene vinyl acetate, such as ESCORENE7 manufactured by Exxon Chemical Co. of Baytown, Tex. The weight percentages are 90% low density polyethylene and 10% ethylene vinyl acetate. Alternatively, the base material is composed of Rexene 1206, manufactured by Rexene Corporation of Odessa, Tex. The primary characteristics of the base material are that it bonds readily to the breakaway material of the breakaway strip 28 in the manner discussed above, and it provides a modicum of thermal resistance so that it does not melt while bonding other materials thereto.

The non-sealable material used to form the non-sealable strips 222, 224, and 226 is a heat-resistant material such as polypropylene, nylon, or high density polyethylene.

The top and bottom films 212, 214 are composed of two or more layers of material. The outer layer of material is a heat-resistant material such as polyethylene terephthalate (PET), oriented polypropylene, or biaxially-oriented nylon. The inner layer of material is a sealant material such as a combination of low density polyethylene and ethylene vinyl acetate.

Figure 15:
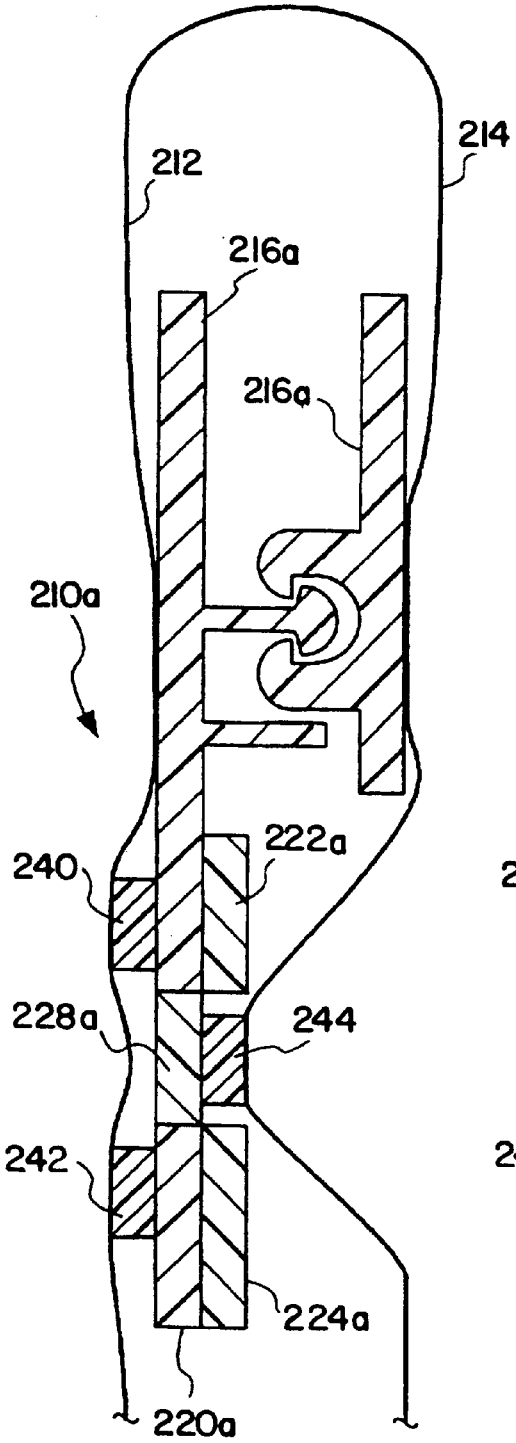
FIG. 15 is a sectional view of yet another embodiment of another closure arrangement embodying the present invention, showing a breakaway seal prior to being broken.
Figure 16:
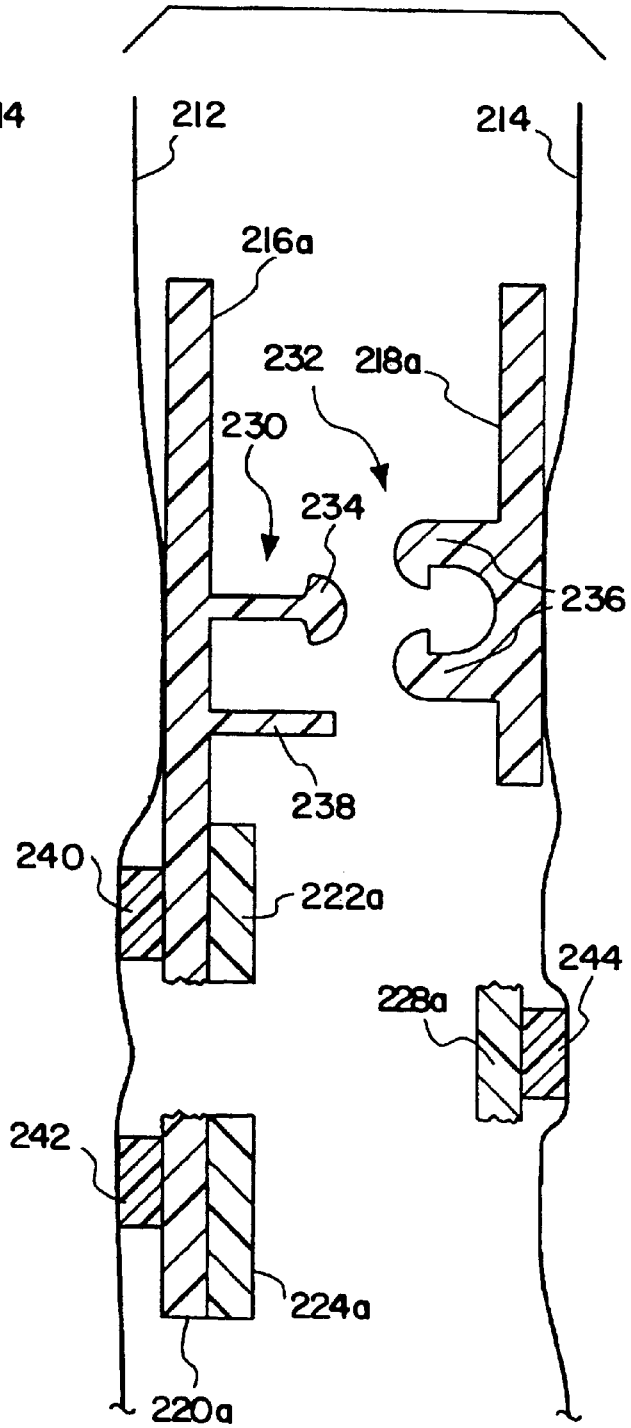
FIG. 16 is a sectional view of the closure arrangement in FIG. 15, showing the breakaway seal after being broken.

FIGS. 15 and 16 illustrate a sectional view of a second closure arrangement 210*a* for a reclosable bag having a top film 212 and a bottom film 214. The closure arrangement 210*a* includes a plurality of flat base strips 216*a*, 218*a*, and 220*a*, a plurality of flat non-sealant strips 222*a* and 224*a*, a plurality of sealant strips 240, 242 and 244, and a flat breakaway strip 228*a*. The top film 212 is heat-fused to the outer surface of the base strip 216*a* and to the sealant strips 240 and 242, while the bottom film 214 is heat-fused to the outer surfaces of the base strip 218*a* and the sealant strip 244. The breakaway strip 228*a* is disposed between the spaced base strips 216*a*, 220*a* and is releasably engaged thereto so as to form breakaway seals at the junctions between the breakaway strip 228 and the respective base strips 216*a*, 220*a*. More specifically, an upper side of the breakaway strip 228 is detachably connected to the base strip 216*a* to form a first breakaway seal and the opposing lower side of the breakaway strip 228 is detachably connected to the base strip 220*a* to form a second breakaway seal. To permit these breakaway seals to be broken as depicted in FIG. 16, the inner surface of the breakaway strip 228 is indirectly attached to the bottom film 214 through sealant strip 244.

To open the bag, the top and bottom films 212, 214 are separated from each other by cutting them apart. Alternatively, top and bottom films 212, 214 are separated from each other by ripping along a perforation line, described below with respect to FIGS. 25 and 26. Next, the interlocked closure profiles 230, 232 are detached from each other by grabbing onto the top and bottom films 212, 214 and pulling them apart. Finally, the breakaway seals between the breakaway strip 228*a* and the base strips 216*a*, 220*a* are broken by continuing to pull the top and bottom films 212, 214 in opposite directions. During breakage of these breakaway seals, the base strip 216*a* and the base strip 220*a* remain attached to the top film 212, while the base strip 218*a* and the breakaway strip 228*a* remain attached to the bottom film 214. In this implementation, the breakaway strip 228*a* is formed from the same heat resistant materials as strips 222*a* and 224*a*.

The implementation of FIGS. 15 and 16 also illustrate an alternative that may be used in the FIGS. 13 and 14 implementation. The sealant layers 240, 242 and 244 are formed of a material that will readily bond with the material forming the inner surfaces of films 212 and 214, such as ethylene vinyl acetate (EVA), with the base strips 216, 218 and 220 being formed of less expensive low density polyethylene. This permits heat sealing of the bag at temperatures lower than otherwise possible with other materials, such as heat sealing polyethylene to polyethylene.

Figure 17:
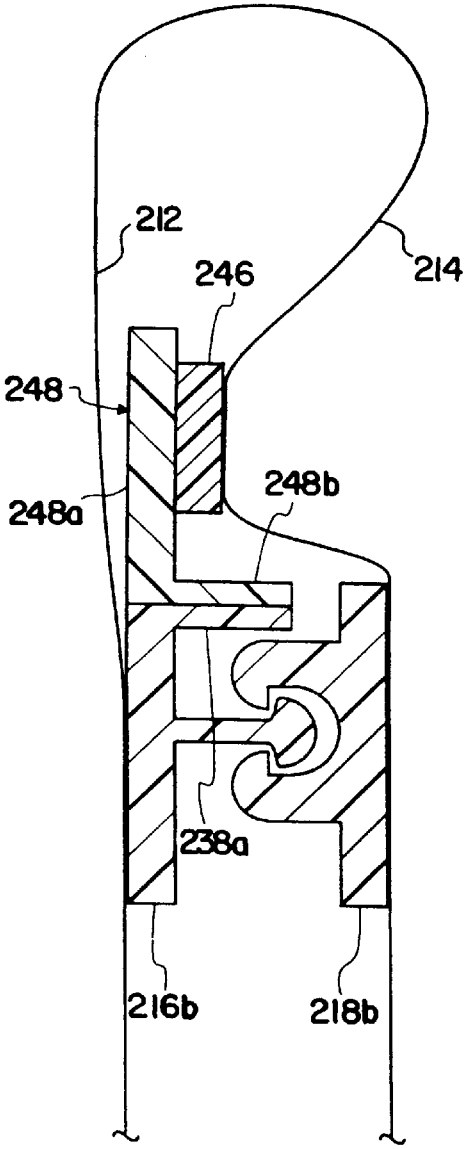
FIG. 17 is a sectional view of another embodiment of a closure arrangement embodying the present invention, showing a breakaway seal prior to being broken.
Figure 18:
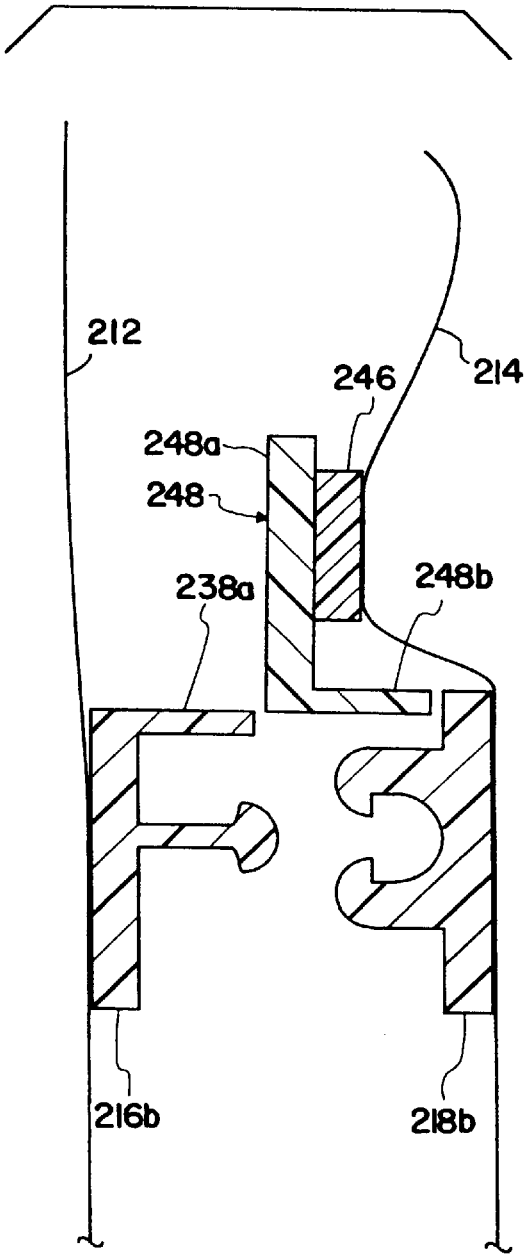
FIG. 18 is a sectional view of the closure arrangement in FIG. 17, showing the breakaway seal after being broken.

FIGS. 17 and 18 illustrate a sectional view of another closure arrangement 210*b* for a reclosable bag having a top film 212 and a bottom film 214. The closure arrangement 210*b* includes a pair of flat base strips 216*b* and 218*b*, a sealant strip 246, and an L-shaped breakaway member 248. The L-shaped breakaway member 248 includes a first leg 248*a* approximately the same thickness as and generally co-planar with the base strip 216*b*. Additionally, the breakaway member 248 includes a second leg 248*b* perpendicular to the first leg 248*a*. The top film 212 is heat-fused to the outer surface of the base strip 216*b*, while the bottom film 214 is heat-fused to the outer surfaces of the base strip 218*a* and the sealant strip 246.

The L-shaped breakaway member 248 is releasably engaged to both the base strip 216*b* and a post 238*a* of the reclosable zipper. More specifically, a lower side of the first leg 248*a* is detachably connected to an upper side of the base strip 216*b* and a lower side of the second leg 248*b* is detachably connected to an upper side of the post 238*a* so as to form a breakaway seal at the junctions between the breakaway member 248*a* and the base strip 216*b* and between the breakaway member 248*b* and the post 238*a*. The strength of this breakaway seal may be adjusted by varying the length (i.e., horizontal dimension in FIGS. 17 and 18) of the second leg 248*b* of the breakaway member 248. Increasing the length of the second leg 248*b* enhances the strength of the breakaway seal. Conversely, decreasing the length of the second leg 248*b* reduces the strength of the breakaway seal. In one implementation, the second leg 248*b* is removed altogether so that the breakaway member 248 only includes the first leg 248*a*. The lower side of this first leg 248*a* is then detachably connected to an upper side of the base strip 216*b* to form a breakaway seal therebetween. To permit the breakaway seal to be broken as depicted in FIG. 17, the inner surface of the first leg 248*a* of the breakaway member 248 is indirectly attached to the bottom film 214 through sealant strip 246.

The breakaway member 248 may be positioned above or below the base strip 216*b*. If the breakaway member 248 is positioned below the base strip 216*b*, the second leg 248*b* of the breakaway member 248 is, of course, formed at the top of the breakaway member, and the post 238*a* of the male closure profile is positioned below, instead of above, the male locking member to permit detachable connection to the breakaway member.

To open the bag, the top and bottom films 212, 214 are separated from each other by cutting them apart. Alternatively, top and bottom films 212, 214 are separated by tearing along a perforation line, described below in conjunction with FIGS. 25 and 26. Next, the breakaway seal between the breakaway member 248 and both the base strip 216*b* and post 238*a* is broken by grabbing onto the top and bottom films 212, 214 and pulling them apart. During breakage of this breakaway seal, the base strip 216*b* remains attached to the top film 212, while the base strip 218*b* and the breakaway member 248 remain attached to the bottom film 214. Finally, the interlocked male and female closure profiles of the reclosable zipper are detached from each other by continuing to pull the top and bottom films 212, 214 in opposite directions.

In implementation illustrated in FIGS. 17 and 18, the sealant layer 246 is composed of a material that will readily bond with the material forming the inner surfaces of films 212 and 214, such as ethylene vinyl acetate (EVA), with the base strips 216*b* and 218*b* and closure profile members being formed of less expensive low density polyethylene. This permits heat sealing of the bag at temperatures lower than otherwise possible with other materials, such as heat sealing polyethylene to polyethylene. The breakaway member 248 is composed of high density polyethylene so that the breakaway seal in FIG. 17 between the breakaway member 248 and both the base strip 216*b* and post 238*a* is weaker than the bond between the sealant strip 246 and the bottom film 214.

Figure 21:
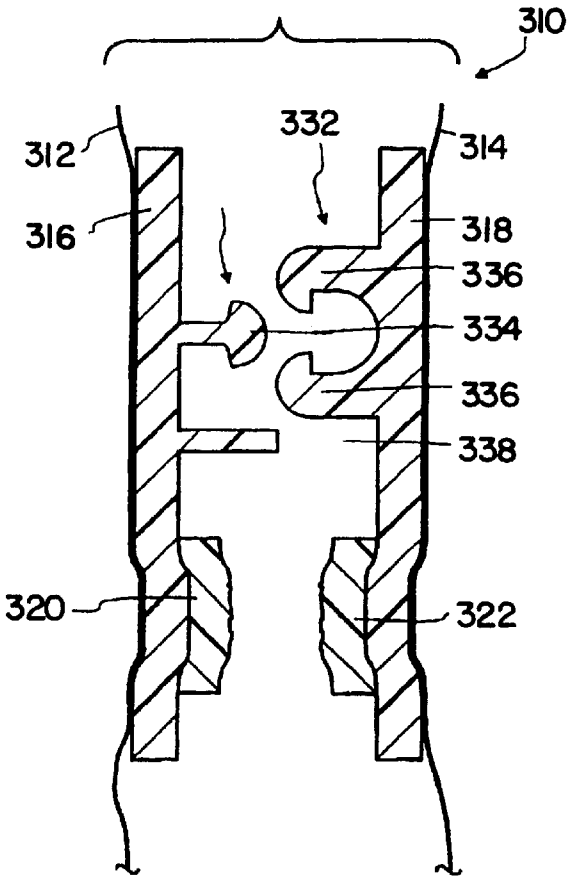
FIG. 21 is the same sectional view as in FIG. 19, after breaking the peelable seal.
Figure 20:
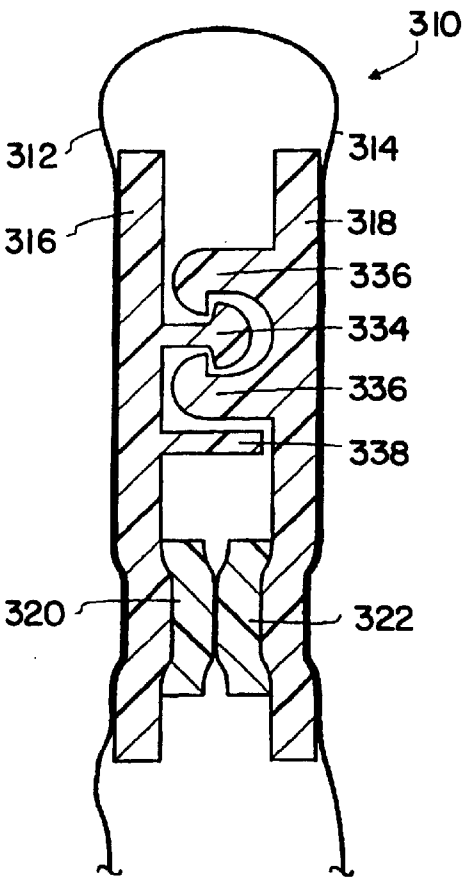
FIG. 20 is the same sectional view of FIG. 19, after forming the peelable seal.
Figure 19:
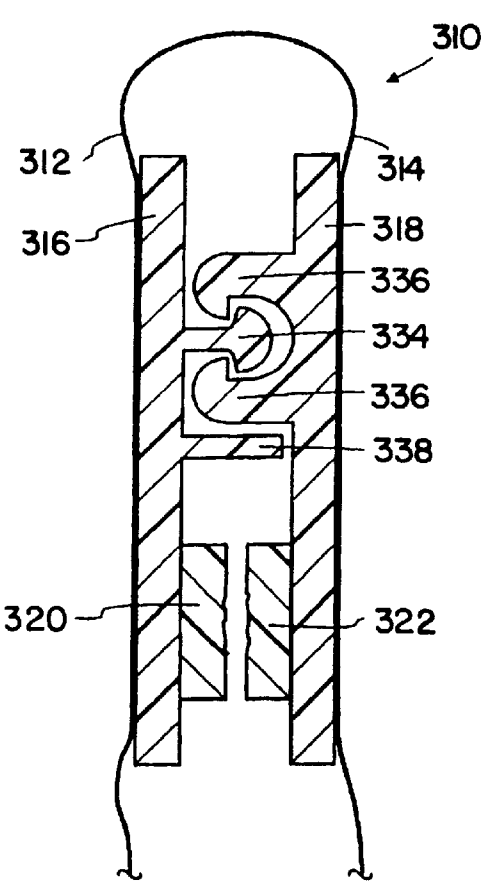
FIG. 19 is a sectional view of a closure arrangement of yet another embodiment of the present invention, prior to forming a peelable seal.

FIGS. 19–21 illustrate a sectional view of another closure arrangement 310 for a reclosable bag having a top film 312 and a bottom film 314. The closure arrangement 310 includes a pair of flat transparent base strips 316, 318 and a pair of flat peelable strips 320, 322. The base strips 316, 318 and the peelable strips 320, 322 are disposed at the mouth of the reclosable bag and extend along the length of the bag mouth. Moreover, the base strips 316, 318 and the peelable strips 320, 322 are parallel to each other along the length of the bag mouth. An outer surface of the base strip 316 is firmly attached to any inner surface of the top film 312, and an outer surface of the base strip 318 is firmly attached to an inner surface of the bottom film 314. The peelable strip 320 is attached to the inner surface of the base strip 316, and the peelable strip 322 is attached to the inner surface of the base strip 318. Thus, the peelable strips 320, 322 are situated between the base strips 316, 318.

To provide the closure arrangement 310 with a reclosable zipper, the base strips 316, 318 have integrally formed therewith respective male and female closure profiles 330, 332. The male closure profile 330 extends inwardly from the inner surface of the base strip 316 and includes a single locking member 334 with an expanded head. The female closure profile 332 extends inwardly from the upper flange portion of the base strip 318 and includes a pair of flexible locking members 336 with hooks at the ends thereof. The pair of locking members 336 are disposed opposite the single locking member 334 and are spaced by a sufficient distance that the expanded head of the single locking member 334 is releasably engageable between the pair of locking members 336. More specifically, the pair of locking members 336 interlock with the single male locking member 334 in a snapping action caused by bringing the hooks of the pair of locking members 336 passed the expanded head of the locking member 334. To facilitate alignment of the pair of locking members 336 with the locking member 334 during reclosure, the male closure profile 330 is provided with a guide post 338 for guiding one of the pair of locking members 336 between the guide post 338 and the locking member 334. If desired, the closure arrangement 310 may be designed without a reclosable zipper. In addition, the closure arrangement 310 may be designed without the base strips 316, 318 so that the peelable strips 320, 322 and the closure profiles 330, 332 are attached directly to the respective top and bottom films 312, 314 of the reclosable bag.

The closure arrangement 310 is manufactured using conventional extrusion and heat sealing techniques. In particular, the base strips 316, 318, the peelable strips 320, 322, and the closure profiles 330, 332 are co-extruded through a die plate fed by a plurality of extruders. These extruders carry the different molten materials for forming the base strips 316, 318, the peelable seals 320, 322, and the closure profiles 330, 332. As is well-known in the art, the die plate includes input ports, output ports, and channels connecting these input ports to output ports. The extruders feed the different molten materials to different input ports, and the channels are designed to configure the molten materials into the shapes of the base strips 316, 318, the peelable strips 320, 322, and the closure profiles 330, 332. The output ports are arranged such that the base strips 316, 318, the peelable strips 320, 322, and the closure profiles 330, 332 exit the die plate with the connections shown in FIG. 1. Since the base strip 316, male closure profile 330, and the peelable strip 320 are separated from the base strip 318, the female closure profile 332, and the peelable strip 322, it should be apparent that these two separate sets of elements may be formed in separate extrusions using two different die plates.

After extruding the base strips 316, 318, the peelable strips 320, 322, and the closure profiles 330, 332, the top and bottom films 312, 314 are heat-fused to the respective base strips 316, 318 using heat seal bars. These heat seal bars are also employed to generate a peelable seal between the peelable strips 320, 322 (FIG. 20).

During manufacture of the closure arrangement 310, the various bonds or attachments between different materials are formed such that the weakest bond is formed at the location of the peelable seal. By forming the weakest bond at the location of the peelable seal, the application of opening forces to the closure arrangement 310 will cause the peelable seal to rupture first. Since the other bonds are stronger than the peelable seal, these other bonds will not rupture in response to the application of opening forces.

The peelable strips 320, 322 are disposed opposite each other along the length of the bag mouth so that they may be heat sealed to form a peelable seal between the peelable strip 320, 322. Prior to forming the peelable seal, the peelable strips 320, 322 are unattached as shown in FIG. 19. After forming the peelable seal, the peelable strips 320, 322 are attached to each other (FIG. 20). As shown in FIG. 20, after forming the peelable seal but prior to initially opening a polymeric bag incorporating the closure arrangement 310, the peelable seal formed by the peelable strips 320, 322 is intact, the closure profiles 330, 332 are interlocked with each other, and the top and bottom films 312, 314 are connected at the mouth end of the bag. The top and bottom films 312, 314 either are heat-fused together at the mouth end of the bag or are formed from a single piece of film. Since the peelable seal between the peelable strips 320, 322 already provides a hermetic seal for the bag, the top and bottom films 312, 314 may alternatively be disconnected from each other at the mouth end.

Referring to FIG. 21, to open the bag, the top and bottom films 312, 314 are separated from each other by cutting them apart. Alternatively, the top and bottom films 312, 314 are separated by tearing along a perforation line, described below in conjunction with FIGS. 25 and 26. Next, the interlocked closure profiles 330, 332 are detached from each other by grabbing onto the top and bottom films 312, 314 and pulling them apart. Finally, the peelable seal between the peelable strips 320, 322 is broken by continuing to pull the top and bottom films 312, 314 in opposite directions. During breakage of the peelable seal, the peelable strip 320 remains attached to the base strip 316, and the peelable strip 322 remains attached to the base strip 318.

To provide evidence of tampering, breaking the peelable seal of the closure arrangement 310 causes the peelable seal region to undergo a change in appearance and texture. This change in appearance provides the consumer with a visual indication that the peelable seal has been broken. In one implementation, the peelable strip 320 is dyed a first opaque color such as blue, black, purple, green, etc., and the peelable strip 322 is dyed a second color, such as yellow, white, orange, etc., which is lighter than the first color. This second color may either be somewhat translucent or virtually opaque.

When the peelable strips 320, 322 are aligned next to one another prior to forming the peelable seal (FIG. 19), the darker first color of the peelable strip 320 cannot be seen through the lighter second color of the peelable strip 322 when viewing the polymeric bag from the right side in FIG. 19. The second color of the peelable strip 322 substantially masks the first color of the peelable strip 320. Similarly, lighter second color of the peelable strip 322 cannot be observed through the darker first color of the peelable strip 320 when viewing the polymeric bag from the left side in FIG. 19. When, however, the two peelable strips 320, 322 are heat sealed to each other to form a peelable seal, the darker first color of the peelable strip 320 is clearly visible through the lighter second color of the peelable strip 322 only in the area that has been heat sealed by a heat seal bar, though minute speckles of the lighter color may remain visible in the heat seal area. In one implementation, the color of the heat sealed area is a blend of the first and second colors. The portion of the peelable strip 320 outside the heat-sealed area remains hidden or obscured by the peelable strip 322. After the peelable seal is broken, by accident in transit or by deliberate tampering, the darker color will no longer show through the lighter color. This masking condition is irreversible so that once the peelable seal is broken, the peelable seal can never again resemble an intact seal. In addition to generating the masking condition, breaking the peelable seal also roughens the texture of the peelable strips 320, 322.

If, for example, the first opaque color is blue and the second opaque color is yellow, forming a peelable seal allows one to see the blue color of the peelable strip 320 through the yellow peelable strip 322 only in the area where the heat seal bar has been applied. In one implementation, the heat sealed area is a slightly different shade of blue compared to the original blue color of the peelable strip 320. Once the peelable seal is broken, the blue color of the peelable strip 320 will no longer be visible through the yellow peelable strip 322. The yellow peelable strip 322 substantially conceals the blue peelable strip 322 even if the two peelable strips 320, 322 are manually pressed together. As stated above, this masking condition is irreversible.

In an alternative implementation, the peelable strips 320, 322 are each colorless and are each translucent or hazy due to the roughened inner surfaces of the peelable strips 320, 322. When the peelable strips 320, 322 are lying atop one another but are not yet sealed to one another, the area of the peelable strips 320, 322 is opaque or hazy. When, however, the two peelable strips 320, 322 are heat sealed to each other to form a peelable seal, the area where a heat seal bar has been applied is substantially clear because the heat seal bar smoothes the roughened surfaces of the peelable strips 320, 322 in the area of the peelable seal. When the peelable seal is broken, the area of the peelable seal reverts back to being hazy.

Figure 24:
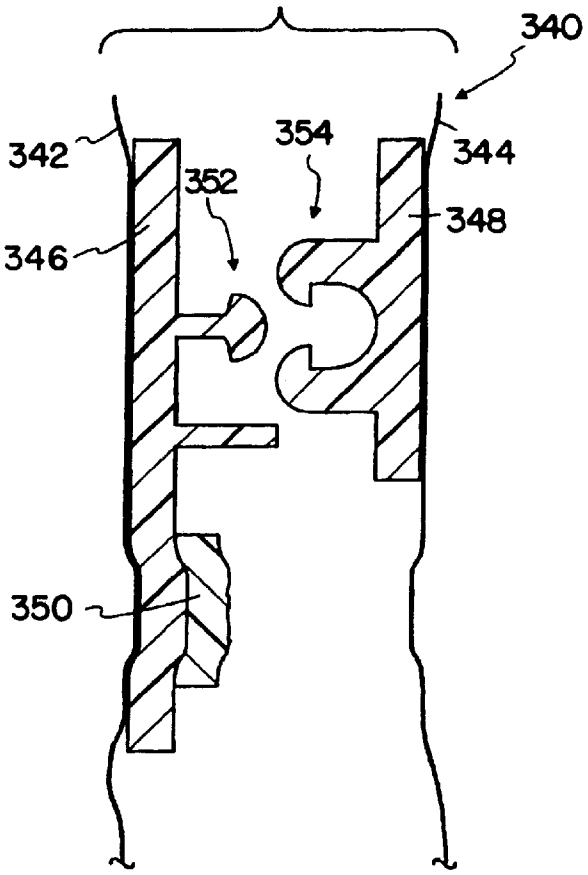
FIG. 24 is the same sectional view as in FIG. 22, after breaking the peelable seal.
Figure 23:
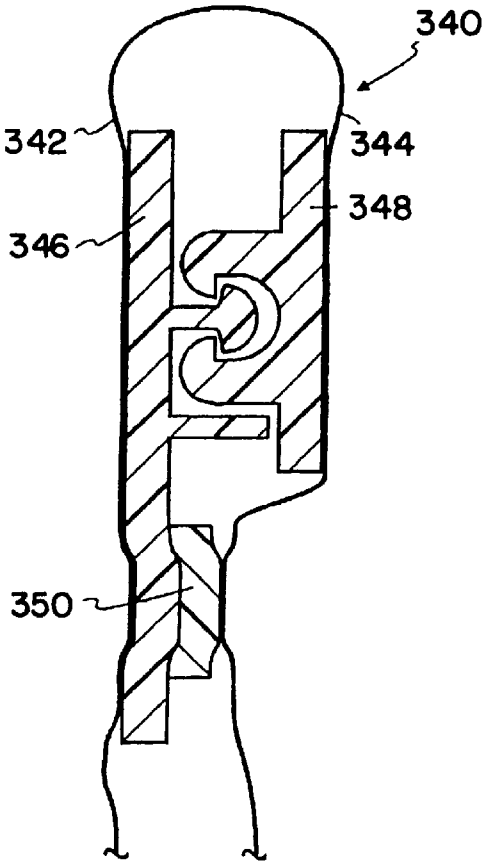
FIG. 23 is the same sectional view as in FIG. 22, after forming the peelable seal.
Figure 22:
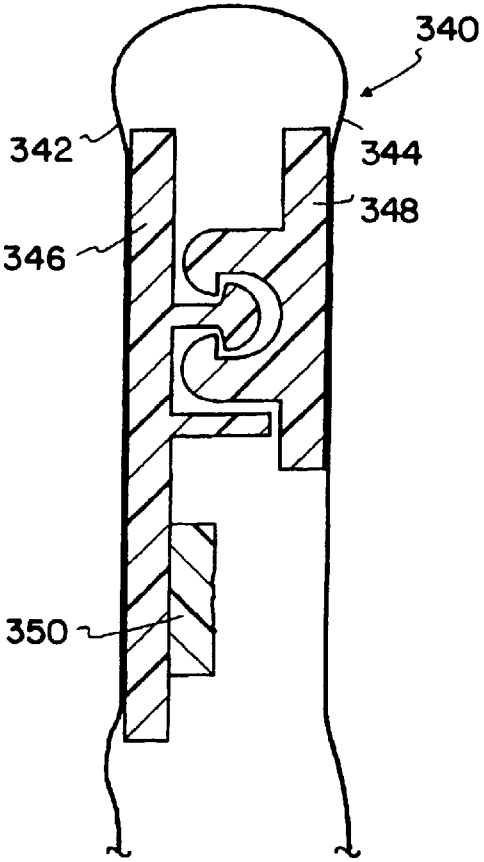
FIG. 22 is a sectional view of another embodiment of the present invention, prior to forming a peelable seal.

FIGS. 22–24 illustrate an alternative closure arrangement 340 for a reclosable bag having a top film 342 and a bottom film 344. The closure arrangement 340 includes a pair of flat transparent base strips 346, 348 and a single flat peelable strip 350. The base strips 346, 348 and the peelable strip 350 are disposed at the mouth of the reclosable bag and extend along the length of the bag mouth. An outer surface of the base strip 346 is firmly attached to an inner surface of the top film 342. The base strip 348 is generally parallel to and opposes the base strip 346, and an outer surface of the base strip 348 is firmly attached to an inner surface of the bottom film 344. To accommodate the peelable strip 350, the base strip 346 is wider, i.e., has a longer vertical dimension in FIGS. 22–24, than the base strip 348. The peelable strip 350 is attached to the inner surface of the base strip 346 and is disposed between the base strip 346 and the bottom film 344.

If desired, the base strips 346, 348 may be provided with a reclosable zipper with associated male and female closure profiles 352, 354. The interaction of these closure profiles 352, 354 is identical to the interaction of the closure profiles 330, 332 described in connection with FIGS. 19–21.

Like the closure arrangement 310 in FIGS. 19–21, the closure arrangement 340 in FIGS. 22–24 is manufactured using conventional extrusion and heat sealing techniques. The base strips 346, 348, the peelable strip 350, and the closure profiles 352, 354 are co-extruded with each other through a single die plate. If desired, however, separate die plates may be used to separately extrude the opposite sides of the closure arrangement 340. After extruding the aforementioned elements of the closure arrangement 340, the top and bottom films 342, 344 are heat-fused using heat seal bars to the respective base strips 346, 348. These heat seal bars are also employed to generate a peelable seal between the peelable strip 350 and the bottom film 344 (FIG. 23).

Prior to forming the peelable seal, the peelable strip 350 and the bottom film 344 are unattached as shown in FIG. 24. After forming the peelable seal, the peelable strip 350 is attached to the bottom film 344 (FIG. 23). As shown in FIG. 23, after forming the peelable seal but prior to initially opening a polymeric bag incorporating the closure arrangement 340, the peelable seal formed by the peelable strip 350 and the bottom film 344 is intact, the closure profiles 352, 354 are interlocked with each other, and the top and bottom films 342, 344 are connected at the mouth end of the bag. The top and bottom films 342, 344 either are heat-fused together at the mouth end of the bag or are formed from a single piece of film. Since the peelable seal between the peelable strip 350 and the bottom film 344 already provides a hermetic seal for the bag, the top and bottom films 342, 344 may alternatively be disconnected from each other at the mouth end.

Referring to FIG. 24, to open the bag, the top and bottom films 42, 44 are separated from each other by cutting them apart. Alternatively, the top and bottom films 42, 44 are separated by tearing along a perforation line, described below in conjunction with FIGS. 25 and 26. Next, the interlocked closure profiles 352, 354 are detached from each other by grabbing on the top and bottom films 342, 344 and pulling them apart. Finally, the peelable seal between the peelable strip 350 and the bottom film 344 is broken by continuing to pull the top and bottom films 342, 344 in opposite directions. During breakage of the peelable seal, the peelable strip 350 remains attached to the base strip 346.

To provide evidence of tampering, breaking the peelable seal of the closure arrangement 340 causes the peelable seal region to undergo a change in appearance and texture. This change in appearance is a visual signal that the peelable seal has been broken. The bottom film 344 of the polymeric bag is pigmented a somewhat translucent first color, such as white, yellow, orange, etc., either by being printed with a layer of ink or being dyed with ink. If desired, this first color may be virtually opaque. The peelable strip 350 is dyed a second opaque color, such as blue, black, purple, green, etc., which is darker than the first color of the bottom film 344.

When the peelable strip 350 and the bottom film 344 are aligned next to one another prior to forming the peelable seal (FIG. 22), the darker second color of the peelable strip 350 can hardly be seen through the lighter first color of the bottom film 344 when viewing the polymeric bag from the right side in FIG. 22. The first color of the bottom film 344 substantially masks the second color of the peelable strip 350. When the darker peelable seal 350 is heat sealed to the lighter colored bottom film 344 to form a peelable seal, the darker second color of the peelable strip 350 is clearly visible through the lighter first color of the bottom film 344 in the area that has been heat sealed by a heat seal bar. The bottom film 344 still substantially obscures the second color of the peelable strip 350 in the area outside the heat sealed area. When, however, the peelable seal between the peelable strip 350 and the bottom film 344 is broken, the darker peelable strip 350 can barely be seen through the lighter colored bottom film 344, even when the peelable strip 350 and the bottom film 344 are manually pressed together. This masking condition is irreversible.

If, for example, the bottom film 344 is colored white and the peelable strip 350 is colored opaque blue, the formation of a peelable seal allows one to see the blue color of the peelable strip 350 through the white bottom film 344 in the area where the heat seal bar was applied. Once the peelable seal is broken, the blue color of the peelable strip 350 will barely be visible through the white bottom film 344. The white bottom film 344 substantially conceals the blue peelable strip 350 even if the peelable strip 350 and the bottom film 344 are manually pressed together.

Compositions of the various portions of the closure arrangements 310 and 340 are described below. More specifically, the peelable material used to form the peelable strips 320, 322 in FIGS. 19–21 and the peelable strip 350 in FIGS. 22–24 is a mixture of three components. First, the peelable material includes an ethylene vinyl acetate (EVA) copolymer such as Product No. AT 3325M EVA manufactured by AT Plastics, Inc. of Edmonton, Alberta, Canada. Second, the peelable material includes a polyethylene-based wax such as C-15 Epolene Wax manufactured by Eastman Chemical Company of Longview, Tex. Third, the peelable material includes a polypropylene such as ESCORENE® manufactured by Exxon Chemical Company of Baytown, Tex. The weight percentages of the foregoing three components of the peelable material are 20–80% EVA copolymer, 5–45% polyethylene-based wax, and 5–45% polypropylene. The peelable material is colored as described previously by the addition of an appropriate dye.

The base material used to form the base strips 316, 318 in FIGS. 19–21, the closure profiles 330, 332 in FIGS. 19–21, the base strips 346, 348 in FIGS. 22–24, and the closure profiles 352, 354 in FIGS. 22–24 is composed of a heat resistant mixture of two components. First, the base material includes a low density polyethylene such as Product No. 412FA manufactured by Westlake Polymers Corporation of Lake Charles, La. Second, the base material includes an EVA copolymer manufactured by Exxon Chemical Company as Product Number 722.62. The weight percentages are 90% low density polyethylene and 10% EVA copolymer. Alternatively, the base material may be composed of Rexene 1205C manufactured by Rexene Corporation of Odessa, Tex. The primary characteristics of the base material are that it bonds readily to the peelable material of the peelable strips and it provides a modicum of thermal resistance so that it does not melt while bonding other materials thereto.

The top and bottom films 312, 314 in FIGS. 19–21 and the top and bottom films 342, 344 in FIGS. 22–24 are composed of two or more layers of material. The outer layer of material is a heat-resistant material such as polyethylene terephathalate, oriented polypropylene, or biaxially-oriented nylon. The inner layer of material is a sealant material such as a combination of low density polyethylene and ethylene vinyl acetate.

While the present invention has been described with reference to several particular implementations, those skilled in the art will recognize that many changes may be made thereto without departing from the spirit and scope of the present invention.

For example, the closure arrangements 310 and 340 may be modified either to remove the reclosable zipper or to position the reclosable zipper below, instead of above, the peelable seal. In the latter situation, the base strips of each closure arrangement are provided with a lower flange portion with closure profiles attached respectively thereto. Furthermore, the closure arrangements 310 and 340 may be designed without their base strips so that the peelable strips and the reclosable zippers are attached directly to the top and bottom films of the reclosable bag.

In addition, the closure arrangement 340 in FIGS. 22–24 may be designed to provide a peelable seal between the peelable strip 350 and the base strip 348, where the base strip 348 is widened to appear similar to the base strip 318 in FIGS. 19–21. In this case, the widened base strip 348 is pigmented the lighter first color and the peelable strip 350 is still pigmented the darker second color.

Figure 25:
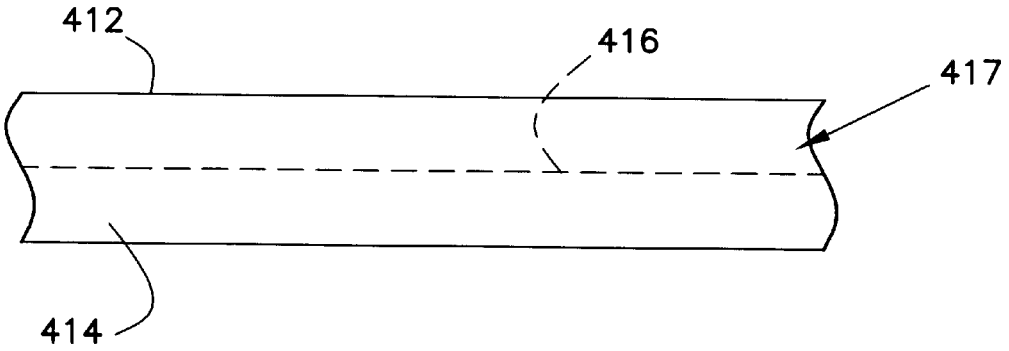
FIG. 25 is a top plan view of an alternative embodiment of any of the embodiments of FIGS. 1, 3, 5, 7, 9, 11, 13, 15, 17, 19, and 22.

Any of the implementations of FIGS. 1, 3, 5, 7, 9, 11, 13, 15, 17, 19, and 22 may be modified as illustrated in FIG. 25. FIG. 25 is a top plan view of the closure arrangements illustrated in FIGS. 1, 3, 5, 7, 9, 11, 13, 15, 17, 19, and 22. Top and bottom films 412, 414 are either a single piece of film or heat fused together at the mouth of the bag. The films include a perforation strip 416 at the bight section, or fold line 417, of top and bottom films 412, 414. Perforation strip 416 facilitates in the user opening the closure arrangement. Rather than having to cut apart top and bottom films 412, 414, the user may simply rip top and bottom films 412, 414 along perforation strip 416. This results in added convenience for the user because the user does not need to search for a scissors or another cutting device to open the bag. Further, the perforation will ensure that the resulting opening will be substantially in the middle of the bight section or fold line, and prevent any part of the film from ripping down to the zipper closure or peelable seal arrangement.

Figure 26:
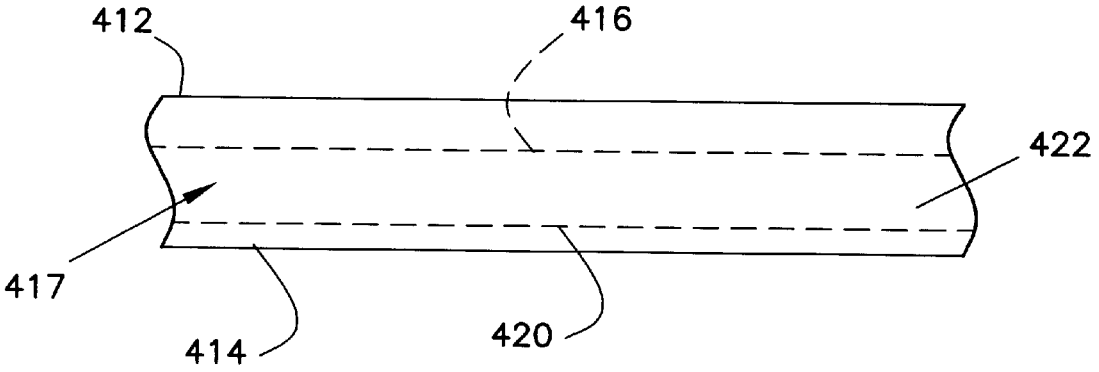
FIG. 26 is a top plan view of another alternative embodiment of any of the embodiments of FIGS. 1, 3, 5, 7, 9, 11, 13, 15, 17, 19, and 22.

An alternative to the implementation of FIG. 25 is illustrated in FIG. 26. This implementation also may be used with any of the closure arrangements illustrated in FIGS. 1, 3, 5, 7, 9, 11, 13, 15, 17, 19, and 22. In the FIG. 26 implementation, first and second perforation strips 416, 420 are at fold line 417 of top and bottom films 412, 414. A holding region 422 lies between first and second perforation strips 418, 420 along fold line 417. To open the closure arrangement, the user grasps the bag with one hand, pinches the holding region 422 with his second hand, and pulls the holding region 422 to rips along both first and second perforation strips 418, 420. The holding region 422 is totally removed from the bag, and may then be discarded.

It is contemplated that variations to the FIGS. 25 and 26 implementations may be made. For example, a tear string may be added to help rip along the perforation. Further, hang holes may be added to the header region alone, or in combination with a tear string, to allow the bag to be displayed on a hanging rack.

While the present invention has been described with reference to several particular embodiments, those skilled in the art will recognize that many changes may be made thereto without departing from the spirit and scope of the present invention. For example, each of the closure arrangements may be modified either to remove the reclosable zipper or to position the reclosable zipper below, instead of above, the peelable seal. In the latter situation, the opposing pair of base strips of the closure arrangement are modified to include portions below the peelable seal onto which the closure profiles may be formed. The following claims set forth the scope of the present invention.

What is claimed is:

1. A bag comprising:

first and second opposing films each having inner and outer surfaces and being joined at a fold line and being perforated along the fold line;

first and second opposing base strips each having an inner and outer surface, the outer surfaces of the first and second base strips being secured to inner surfaces of the respective first and second films;

a pair of sealant bands firmly attached to the inner surface of said first film; and a pair of peelable bands having opposing surfaces, one of the opposing surfaces being detachably connected to the inner surface of said second base strip and the other of the opposing surfaces being firmly attached to the sealant bands to form one-time peelable seals.

2. The bag of claim 1, wherein the first and second opposing films being perforated along the fold line include a first perforation line and a second perforation line.

3. A method of manufacturing a bag comprising:

providing a continuous polymeric film;

perforating the film along a line to divide the film into first and second films having inner and outer surfaces;

providing first and second opposing base strips each having an inner and outer surface;

securing the outer surfaces of the first and second base strips to the inner surfaces of the respective first and second films;

providing a pair of sealant bands;

securing the sealant bands to the inner surface of the first film;

providing a pair of peelable bands having a pair of opposing surfaces; and detachably connecting one of the opposing surfaces of the pair of peelable bands to the inner surface of the second base strip, and attaching the other of the opposing surfaces of the pair of peelable bands to form a one-time peelable seal.

4. The method of claim 3, wherein the step of perforating includes perforating the film along a first perforation line and a second perforation line.

* * * * *